US009964868B2

(12) United States Patent
Fujii

(10) Patent No.: US 9,964,868 B2
(45) Date of Patent: May 8, 2018

(54) ELECTROPHOTOGRAPHIC PHOTORECEPTOR, ELECTROPHOTOGRAPHIC PHOTORECEPTOR CARTRIDGE, AND IMAGE FORMING APPARATUS

(71) Applicant: MITSUBISHI CHEMICAL CORPORATION, Chiyoda-ku (JP)

(72) Inventor: Akiteru Fujii, Kanagawa (JP)

(73) Assignee: MITSUBISHI CHEMICAL CORPORATION, Chiyoda-ku (JP)

( * ) Notice: Subject to any disclaimer, the term of this patent is extended or adjusted under 35 U.S.C. 154(b) by 0 days. days.

(21) Appl. No.: 15/429,558

(22) Filed: Feb. 10, 2017

(65) Prior Publication Data

US 2017/0235240 A1 Aug. 17, 2017

(30) Foreign Application Priority Data

Feb. 12, 2016 (JP) ..... 2016-024976

(51) Int. Cl.
*G03G 5/047* (2006.01)

(52) U.S. Cl.
CPC ..... *G03G 5/047* (2013.01)

(58) Field of Classification Search
CPC ..... G03G 5/0696
See application file for complete search history.

(56) References Cited

U.S. PATENT DOCUMENTS

| | | | | |
|---|---|---|---|---|
| 5,302,479 | A | 4/1994 | Daimon et al. | |
| 5,393,629 | A | 2/1995 | Nukada et al. | |
| 5,885,737 | A | 3/1999 | Tanaka | |
| 5,897,250 | A | 4/1999 | Hirai et al. | |
| 5,932,722 | A | 8/1999 | Hirai et al. | |
| 2011/0159418 | A1* | 6/2011 | Sakaguchi | G03G 5/0677 430/56 |
| 2012/0003576 | A1 | 1/2012 | Tanaka et al. | |
| 2013/0029266 | A1 | 1/2013 | Sugiyama et al. | |
| 2014/0134525 | A1* | 5/2014 | Anezaki | G03G 5/078 430/56 |
| 2014/0212800 | A1 | 7/2014 | Miura et al. | |
| 2016/0124327 | A1 | 5/2016 | Fujii et al. | |

FOREIGN PATENT DOCUMENTS

| | | |
|---|---|---|
| JP | 3166293 | 5/2001 |
| JP | 3639691 | 4/2005 |
| JP | 2012-32781 | 2/2012 |
| JP | 2013-50699 | 3/2013 |
| JP | 2014-160239 | 9/2014 |
| JP | 2015-92238 | 5/2015 |

* cited by examiner

*Primary Examiner* — Peter L Vajda
(74) *Attorney, Agent, or Firm* — Oblon, McClelland, Maier & Neustadt, L.L.P.

(57) ABSTRACT

The invention relates to a multilayer type electrophotographic photoreceptor comprising: a conductive support; and, on the conductive support, a charge generation layer containing a hydroxygallium phthalocyanine pigment and a charge transport layer, wherein the content of α-chloronaphthalene in hydroxygallium phthalocyanine pigment in the charge generation layer is in a range of 0 ng/cm$^2$ to 0.1 ng/cm$^2$, the charge transport layer contains a non-halogen organic solvent having a boiling point of 140° C. or more, and the content of the non-halogen organic solvent having a boiling point of 140° C. or more is in a range of 0.1 μg/cm$^2$ to 5 μg/cm$^2$.

11 Claims, 1 Drawing Sheet

ELECTROPHOTOGRAPHIC PHOTORECEPTOR, ELECTROPHOTOGRAPHIC PHOTORECEPTOR CARTRIDGE, AND IMAGE FORMING APPARATUS

FIELD OF INVENTION

The present invention relates to an electrophotographic photoreceptor which defines the amount of residual solvents, an electrophotographic photoreceptor cartridge, and an image forming apparatus.

BACKGROUND OF INVENTION

The electrophotographic technique can instantaneously obtain a high quality image, and thus has been widely used as a copying machine, a printer, and a printing machine. As an electrophotographic photoreceptor (hereinafter, appropriately referred to as a "photoreceptor") which is a core member of an electrophotographic process, a photoreceptor which uses an organic photoconductive material and has advantages of film formation without pollution and easy manufacture has been widely used.

On the other hand, in an electrophotographic system, image stability is inferior as compared with offset printing, particularly, in a case of printing a large number of images requiring delicate color reproducibility, many problems such as changes in color tone and image defects still remain to be solved.

Among them, the electrophotographic photoreceptor is repeatedly used in the electrophotographic process, that is, in a cycle of charging, exposing, developing, transferring, cleaning, erasing, and the like, and during the cycle, the electrophotographic photoreceptor is gradually deteriorated under various loads. Examples of such various loads include a high voltage load due to a corona charger which is commonly used as a charger and a chemical load due to strong oxidizing ozone or NOx which is generated at the time of discharge, an electrically conductive load due to a carrier generated by exposure, mechanical load due to a high voltage load, toner, a carrier, a paper component, or a cleaning member at the time of transfer, a photochemical load of a photosensitive layer composition due to erasing light or the light from the outside. For this reason, in order to suppress fluctuation in image properties in a case where the electrophotographic process is repeated many times, it is necessary to enhance resistance with respect to the aforementioned loads.

Since the printing is performed under various temperature and humidity conditions, it is required to have less influence on these temperature and humidity fluctuations. Among such requirements, a method for suppressing performance change with respect to humidity fluctuations by using hydroxygallium phthalocyanine as charge generation material of the photoreceptor has been widely used (refer to Patent Documents 1 to 3).

As means for improving the stability in use, Patent Document 4 discloses stabilization of surface lubricity, and Patent Document 5 discloses stabilization of light potential. Both of Patent Documents 4 and 5 disclose that the stabilization is achieved by using a high boiling point solvent for a charge transport layer.

Document List

[Patent Document 1] Japanese Patent No. 3166293
[Patent Document 2] Japanese Patent No. 3639691

[Patent Document 3] JP-A-2012-32781
[Patent Document 4] JP-A-2013-50699
[Patent Document 5]JP-A-2014-160239

SUMMARY OF THE INVENTION

However, the photoreceptor which uses the aforementioned hydroxygallium phthalocyanine as the charge generation material does not have sufficient stability of electrical properties and image stability when being repeatedly used, and thus is required to suppress fluctuation in electric potentials and image ghost. Particularly, in a low-end low-priced printer with no process control mechanism, the stability of the performance through the life of the photoreceptor itself is important.

Further, Patent Document 5 discloses that the stabilization of light potential is achieved by using the high boiling point solvent for the charge transport layer; however, there is a problem that the stabilization is insufficient in terms of the image ghost and the adhesion with the lower layer of the photosensitive layer is deteriorated.

The present inventors have extensively studied for an electrophotographic photoreceptor capable of solving the aforementioned problems, and have found that the aforementioned problems can be solved by combining a specific charge generation layer and a specific charge transport layer, thereby completing the present invention. The gist of the present invention lies in the following items.

(1) A multilayer type electrophotographic photoreceptor comprising: a conductive support; and, on the conductive support, a charge generation layer containing a hydroxygallium phthalocyanine pigment and a charge transport layer, wherein the content of α-chloronaphthalene in hydroxygallium phthalocyanine pigment in the charge generation layer is in a range of 0 ng/cm$^2$ to 0.1 ng/cm$^2$, the charge transport layer contains a non-halogen organic solvent having a boiling point of 140° C. or more, and the content of the non-halogen organic solvent having a boiling point of 140° C. or more is in a range of 0.1 μg/cm$^2$ to 5 μg/cm$^2$.

(2) The multilayer type electrophotographic photoreceptor according to the item (1), wherein the non-halogen organic solvent having a boiling point of 140° C. or more is at least one selected from the group consisting of methyl benzoate, ethyl benzoate, benzyl acetate, ethyl 3-ethoxypropionate, diethylene glycol ethyl methyl ether, and 4-methoxy-4-methyl-2-pentanone.

(3) The multilayer type electrophotographic photoreceptor according to the item (1) or (2), wherein the charge generation layer contains at least one compound selected from an amino compound, an amide compound, and a urea compound.

(4) The multilayer type electrophotographic photoreceptor according to any one of the items (1) to (3), wherein the charge transport layer contains a polyarylate resin.

(5) The multilayer type electrophotographic photoreceptor according to any one of the items (1) to (4), wherein the hydroxygallium phthalocyanine is hydroxygallium phthalocyanine crystal which represents an intense diffraction peak at Bragg angles (2θ±0.2) of 28.3° in an X-ray diffraction pattern with CuKα line.

(6) The multilayer type electrophotographic photoreceptor according to any one of the items (1) to (5), wherein the non-halogen organic solvent having the boiling point of 140° C. or more is o-xylene and methyl benzoate.

(7) An electrophotographic photoreceptor cartridge comprising the electrophotographic photoreceptor according to any one of the items 1 to 6.

(8) An image forming apparatus comprising the electrophotographic photoreceptor according to any one of the items 1 to 7.

There is provided an electrophotographic photoreceptor having excellent stability of electrical properties, low humidity dependency, image memory and ghost which are less likely to occur, preferable adhesion with a lower layer, and excellent image stability, a method of manufacturing the same, an electrophotographic photoreceptor cartridge, and an image forming apparatus.

DETAILED DESCRIPTION OF THE INVENTION

Figure 1:
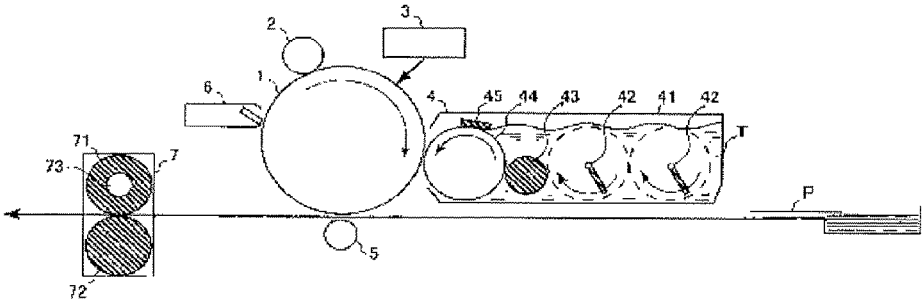
FIG. 1 is a conceptual diagram illustrating an example of an image forming apparatus using an electrophotographic photoreceptor of the present invention.

Hereinafter, the best mode for carrying out the present invention (hereinafter, the embodiment of the invention) will be described in detail. Note that, the present invention is not limited to the following embodiments, and can be carried out with various modifications within the scope of the gist.

1. Electrophotographic Photoreceptor

The electrophotographic photoreceptor to which the present embodiment is applied is a multilayer type photoreceptor at least having a charge generation layer and a charge transport layer on a conductive support.

1-1. Conductive Support

The conductive support is not particularly limited. Examples of conductive supports in main use include: metallic materials such as aluminum, aluminum alloys, stainless steel, copper, and nickel; resinous materials to which electrical conductivity has been imparted by adding a conductive powder such as a metal, carbon, or tin oxide powder; and resins, glasses, paper, or the like, the surface of which has been deposited or coated with a conductive material such as aluminum, nickel, or indium-tin oxide (ITO). One of these materials may be used alone, or any desired combination of two or more thereof may be used in any desired proportion. With respect to the form of the conductive support, the conductive support may be in the form of a drum, sheet, belt, or the like. Furthermore, use may be made of a conductive support which is made of a metallic material and which has been coated with a conductive material having an appropriate resistance value for the purposes of controlling conductivity, surface properties, and the like, and of covering defects. In the case where a metallic material such as an aluminum alloy is used as a conductive support, this material may be used after an anodized coating is formed thereon. In the case where an anodized coating has been formed, it is desirable to subject the material to a pore-filling treatment by a known method.

A surface of the support may be smooth or may be roughened by using a special cutting method or applying a polishing treatment. In addition, the surface of the support may be roughened by mixing particles having an appropriate particle size with the material constituting the support. Further, in order to reduce the cost, it is also possible to use the drawn pipe as it is without performing the cutting treatment.

1-2. Undercoat Layer

An undercoat layer may be disposed between the conductive support and the photosensitive layer which will be described later, in order to improve adhesion, blocking resistance, and the like. As the material of the undercoat layer, use may be made, for example, of a resin or a resin in which particles of a metal oxide or the like have been dispersed. The undercoat layer may be constituted of a single layer or composed of a plurality of layers. In a case where the undercoat layer is formed of a plurality of layers, the undercoat layer can have a two-layer structure formed of a conductive layer (interference fringe prevention layer) and an intermediate layer on the conductive support.

Examples of the metal oxide particles for use in the undercoat layer include particles of a metal oxide containing one metallic element, such as titanium oxide, indium oxide, tin oxide, aluminum oxide, silicon oxide, zirconium oxide, zinc oxide, iron oxide, or barium sulfate, and particles of a metal oxide containing a plurality of metallic elements, such as calcium titanate, strontium titanate, or barium titanate. Particles of one kind selected from these may be used alone, or particles of two or more kinds may be mixed together and used. Preferred of those particulate metal oxides are titanium oxide and aluminum oxide. Especially preferred is titanium oxide. The titanium oxide particles may be ones of which the surface has been treated with an inorganic substance such as tin oxide, aluminum oxide, antimony oxide, zirconium oxide, or silicon oxide or with an organic substance such as stearic acid, a polyol, or siloxane. As the crystal form of the titanium oxide particles, any of rutile, anatase, brookite, and amorphous ones is usable. Furthermore, the titanium oxide particles may include particles in a plurality of crystal states.

Metal oxide particles having various particle diameters can be utilized. However, from the standpoints of properties and the stability of the fluid, the metal oxide particles to be used have an average primary-particle diameter of preferably 10 nm to 100 nm, especially preferably 10 nm to 50 nm. The average primary-particle diameter can be obtained from TEM photographs, and the like.

It is desirable that the undercoat layer should be formed so as to be configured of a binder resin and metal oxide particles dispersed therein. Examples of the binder resin for use in the undercoat layer include known binder resins such as epoxy resins, polyethylene resins, polypropylene resins, acrylic resins, methacrylic resins, polyamide resins, vinyl chloride resins, vinyl acetate resins, phenolic resins, polycarbonate resins, polyurethane resins, polyimide resins, vinylidene chloride resins, polyvinyl acetal resins, vinyl chloride/vinyl acetate copolymers, polyvinyl alcohol resins, polyurethane resins, polyacrylic resins, polyacrylamide resins, polyvinylpyrrolidone resins, polyvinylpyridine resins, water-soluble polyester resins, cellulose ester resins such as nitrocellulose, cellulose ether resins, casein, gelatin, polyglutamic acid, starch, starch acetate, aminostarch, organozirconium compounds such as zirconium chelate compounds and zirconium alkoxide compounds, organotitanyl compounds such as titanium chelate compounds and titanyl alkoxide compounds, and silane coupling agents. One of these binder resins may be used alone, or any desired combination of two or more thereof may be used in any desired proportion. A binder resin may be used together with a hardener to give a cured layer. Preferred of those binder resins are resol-type phenolic resins, alcohol-soluble copolyamides, modified polyamides, and the like, because these resins show satisfactory dispersibility and applicability.

The proportion of the inorganic particles to the binder resin to be used for the undercoat layer can be selected at will. From the standpoint of the stability and applicability of the dispersion, however, it is usually preferred to use the inorganic particles in an amount in the range of 10% by mass to 500% by mass based on the binder resin.

The undercoat layer has any desired thickness unless the effects of the invention are considerably lessened. However, from the standpoints of improving the electrical properties, suitability for intense exposure, image characteristics, and suitability for repetitions of the electrophotographic photoreceptor and improving applicability during production, the thickness thereof is usually equal to or larger than 0.01 μm, preferably equal to or larger than 0.1 μm, and is usually equal to or less than 30 μm, preferably equal to or less than 20 μm. A known antioxidant and the like may be incorporated into the undercoat layer. Pigment particles, resin particles, or the like may be incorporated for the purpose of, for example, preventing the occurrence of image defects such as interference fringes.

1-3. Charge Generation Layer

The charge generation layer is formed by bonding the charge generation substance to the binder resin. Typically, charge generation layer is used usually in the form of a dispersion layer in which a pigment fine particle which is the charge generation substance is bonded with a binder resin of any of various kinds.

As the charge generation substance used for the charge generation layer, hydroxygallium phthalocyanines having a crystal form which exhibits high sensitivity and low humidity dependency of the sensitivity. Among them, the V-form hydroxygallium phthalocyanine disclosed in Patent Document 1, and hydroxygallium phthalocyanine which has a most intense diffraction peak at an angle of 28.1°, or hydroxygallium phthalocyanine which has an obvious peak at an angle of 28.1° without having a peak at angle of 26.2° and a half value width W at angle of 25.9° which is in a range of $0.1° \leq W \leq 0.4°$ disclosed in Patent Document 2, and a G-form μ-oxo-gallium phthalocyanine dimer are more preferable, and among them, the V-form hydroxygallium phthalocyanine, that is, hydroxygallium phthalocyanine having a most intense diffraction peak at an angle of 28.1° is particularly preferable.

The hydroxygallium phthalocyanine pigment can be prepared by using a well-known method. For example, crude gulium phthalocyanine is prepared by using a method of reacting o-phthalodinitrile or 1,3-diiminoisoindoline and gallium trichloride in a certain solvent (an I-type chlorogallium phthalocyanine method); a method of synthesizing a phthalocyanine dimer (phthalocyanine•dimer) by heating and reacting o-phthalodinitrile, alkoxy gallium, and ethylene glycol in a certain solvent (a phthalocyanine•dimer method). As a solvent in the above-described reaction, a non-halogen solvent is used from the standpoint of stability of electrical properties, adhesion, and environmental safety. Specifically, it is possible to usually use an inert high-boiling solvent such as α-methylnaphthalene, methoxynaphthalene, dimethylaminoethanol, diphenylmethane, diphenylethane, ethylene glycol, dialkyl ether, quinoline, sulfolane, dimethylformamide, dimethyl sulfoxide, and dimethyl sulfoamide. Among them, quinoline, sulfolane, dimethylformamide, and dimethyl sulfoxide are preferable, and dimethyl sulfoxide is more preferable. In the reaction solvent, the rate of the non-halogen solvent is preferably equal to or greater than 50% by mass, is more preferably equal to or greater than 80% by mass, is further preferably equal to or greater than 90% by mass, and is particularly preferably 100% by mass. Note that, "non-halogen solvent" of "hydroxygallium phthalocyanine synthesized by using a non-halogen solvent" described in the present invention means a solvent which is used as a reaction solvent in the manufacture of the crude gallium phthalocyanine but is not used in a crystal transformation step described below.

Next, when the crude gallium phthalocyanine obtained by the above-described reaction is further subjected to an acid pasting treatment, the crude gallium phthalocyanine is microparticulated and is converted into the I-form hydroxygallium phthalocyanine pigment. In this regard, the acid pasting treatment means that specifically, a material which is obtained by partially or completely dissolving crude gallium phthalocyanine in an acid such as a sulfuric acid, or a material which is set as an acid salt such as sulfate is poured in an alkaline aqueous solution, water, or water with ice so as to perform recrystallization. As the acid used for the above-described acid pasting treatment, a sulfuric acid is preferable, among them, a sulfuric acid having a concentration of 70% to 100% (particularly, preferably in a range of 95% to 100%) is more preferable.

After performing the acid pasting treatment, when the obtained I-form hydroxygallium phthalocyanine pigment is subjected to the milling treatment together with the solvent, it is possible to obtain the V-form hydroxygallium phthalocyanine pigment having an intense diffraction peak at Bragg angles (2θ±0.2°) of 7.5°, 9.9°, 12.5°, 16.3°, 18.6°, 25.1°, and 28.3° in the X-ray diffraction pattern with CuKα characteristic X-ray. Alternatively, after performing the above-described acid pasting treatment, when a low crystalline hydroxygallium phthalocyanine pigment obtained by further freeze drying is subjected to the milling treatment together with the solvent, it is possible to obtain hydroxygallium phthalocyanine having the maximum peak at Bragg angles (2θ±0.2°) of 28.1° in the X-ray diffraction pattern with CuKα characteristic X-ray.

The milling treatment is a treatment performed by using, for example, dispersion media such as glass beads, steel beads, and alumina balls and a milling apparatus such as a sand mill and a ball mill. The time for the milling treatment is changed depending on the milling apparatus to be used, and is preferably in a range of 4 to 48 hours. The Bragg angle may be checked by taking a sample every 1 to 3 hours. It is preferable that the amount of a dispersant used in the milling treatment is 10 to 50 times the low crystalline hydroxygallium phthalocyanine on a mass basis.

The electrophotographic properties in a case where hydroxygallium phthalocyanine obtained by performing the acid pasting treatment and the milling treatment with crude gallium phthalocyanine synthesized by using a well-known method is used as the charge generation substance are affected by a method of synthesizing the used crude gallium phthalocyanine, and particularly, is greatly affected by the type of organic solvent used for synthesis. That is, even though the crystal forms of the obtained hydroxygallium phthalocyanine are the same as each other, in a case of being used as the electrophotographic photoreceptor, the electrical properties and the image properties are differentiated from each other. The reason for this is that even though the crystal forms are the same each other, the solubility of by-products and impurities with respect to the reaction solvent are different from each other depending the difference of the reaction solvent, and as a result, the residual amounts which are incorporated in the chlorogallium phthalocyanine crystal are different from each other, or the degree of influence in a case where the reaction solvent itself is incorporated in the chlorogallium phthalocyanine crystal is differentiated depending on the types of the reaction solvent, and even in the step of converting into hydroxygallium phthalocyanine through the acid pasting treatment and the milling treatment in the subsequent step, the residues thereof and the reaction solvent still remains without being completely removed. In a charge generation process at light irradiation of the hydroxygallium phthalocyanine pigment, it is known that the fine amount of the residual solvent in crystal greatly affects the charge generation efficiency, and particularly, in a case where the high boiling point solvent remains, it almost permanently stays in the photoreceptor and stably affects the performance under normal use and storage conditions.

In addition, the halogen type solvent contained in hydroxygallium phthalocyanine is preferably to be less from the standpoint of the stability of electrical properties, the adhesion, and the environmental safety, and the residual amount of α-chloronaphthalene which is representatively used is in a range of 0 ng/cm$^2$ to 0.1 ng/cm$^2$, and is particularly preferably not contained at all in an area conversion of the charge generation layer.

The residual solvent contained in hydroxygallium phthalocyanine can be quantified from the electrophotographic photoreceptor as described below. First, an upper layer such as a charge transport layer is removed by using an organic solvent, then charge generation layer components (corresponding to 100 cm$^2$) are separated, the binder resin among them is dissolved by using a solvent, and hydroxygallium phthalocyanine pigment is isolated. Thereafter, the components of the isolated pigment samples were identified and quantified by a GC/MS (SIM) method. For the quantification, first, a calibration curve (peak area vs detection intensity) was created based on a known concentration of a reaction solvent (for example, α-chloronaphthalene) standard material, and the detected amount of solvent was calculated from the calibration curve and the peak area of measurement sample. In addition, a standard material is added before isolating the measurement sample so as to confirm the situation of the recovery rate, and then the detected amount of the solvent is corrected based on the recovery rate.

In addition, when at least one compound selected from an amino compound, an amide compound, and a urea compound is added and the selected compound is milled in the step of obtaining the V-form hydroxygallium phthalocyanine pigment having an intense diffraction peak at Bragg angles (2θ±0.2°) of 7.5°, 9.9°, 12.5°, 16.3°, 18.6°, 25.1°, and 28.3° by the milling treatment in an X-ray diffraction pattern by using CuKα characteristic X-ray, it is possible to incorporate the aforementioned compounds into the V-form hydroxygallium phthalocyanine pigment after crystal conversion. With this, there is an advantage that it is difficult to generate a ghost image even under a severe environment such as under low temperature and low humidity. The mass fraction of the amino compound, the amide compound, and the urea compound with respect to the hydroxygallium phthalocyanine pigment is preferably in a range of 0.05% by mass to 20% by mass from the standpoint of the electrical properties, and is perform in a range of 0.2% by mass to 10% by mass from the standpoint of suppressing the ghost image. The mass fraction of the amino compound, the amide compound, and the urea compound with respect to the hydroxygallium phthalocyanine pigment can be separated and quantified the photoreceptor by using means such as NMR. Preferred examples of the amino compound, the amide compound, and the urea compound are described as follows.

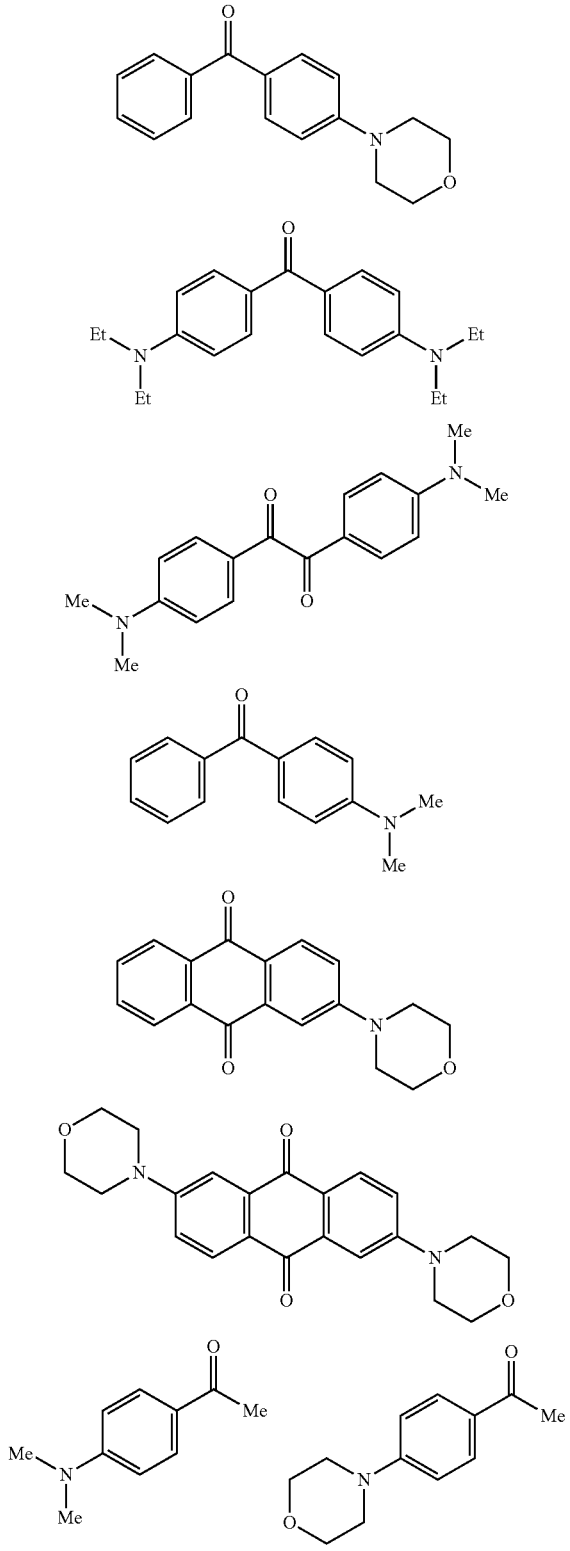

-continued

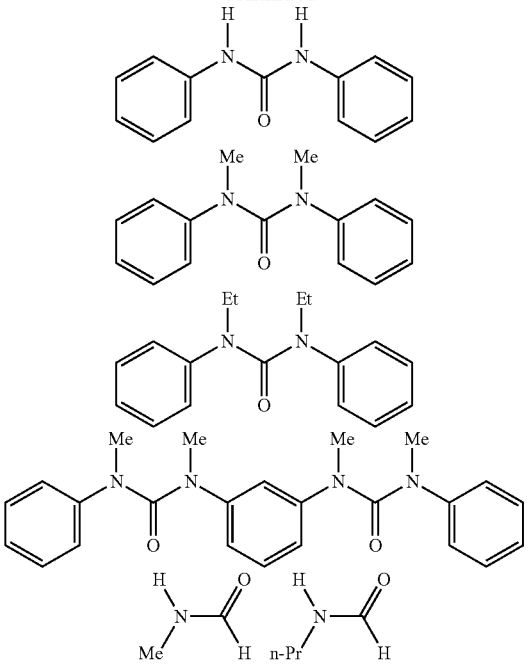

As the charge generation substance, one type of hydroxygallium phthalocyanine pigment may be used alone, and two or more crystal forms of hydroxygallium phthalocyanine pigments may be mixed to be used. Examples of those that may be mixed include metal-free phthalocyanine, metal such as copper, indium, tin, titanium, gallium, zinc, vanadium, silicon, germanium, and aluminum, or those having each crystal form of coordinated phthalocyanine such as an oxide, a halide, a hydroxide, an alkoxide of the metal, and further include phthalocyanine dimers or the like in which an oxygen atom or the like is used as a crosslinking atom. Especially suitable are X-form and τ-form metal-free phthalocyanines, which are crystal forms having high sensitivity, A-form (also called β-form), B-form (also called α-form), or D-form (also called Y-form) titanyl phthalocyanine (also called oxytitanium phthalocyanine), vanadyl phthalocyanine, chloroindium phthalocyanine, hydroxy indium phthalocyanine, II-form chlorogallium phthalocyanine, G-form, I-form, and other μ-oxo-gallium phthalocyanine dimers, and II-form and other μ-oxo-aluminum phthalocyanine dimers.

Further, a hydroxygallium phthalocyanine pigment and a well-known azo pigment may be used in combination. In this case, it is more preferable to use a disazo pigment and a trisazo pigment in combination so as to have spectral sensitivity properties in different spectral regions of the visible region and the near-infrared region.

The binder resin to be used for the charge generation layer is not particularly limited. Examples thereof include: insulating resins such as a polyvinyl acetal resin, for example, a polyvinyl butyral resin, a polyvinyl formal resin, and a partly acetalized polyvinyl butyral resin in which the butyral moieties have been partly modified with formal, acetal, or the like, a polyarylate resin, a polycarbonate resin, a polyester resin, a polyarylate resin, a modified ether-type polyester resin, a phenoxy resin, a polyvinyl chloride resin, a polyvinylidene chloride resins, a polyvinyl acetate resin, a polystyrene resin, an acrylic resin, a methacrylic resin, a polyacrylamide resin, a polyamide resin, a polyvinylpyridine resin, a cellulosic resin, a polyurethane resin, an epoxy resin, a silicon resin, a polyvinyl alcohol resin, a polyvinylpyrrolidone resin, casein, copolymers based on vinyl chloride and vinyl acetate, for example, vinyl chloride/vinyl acetate copolymers, hydroxy-modified vinyl chloride/vinyl acetate copolymers, carboxyl-modified vinyl chloride/vinyl acetate copolymers, and vinyl chloride/vinyl acetate/maleic anhydride copolymers, styrene/butadiene copolymers, vinylidene chloride/acrylonitrile copolymers, styrene-alkyd resins, silicon-alkyd resins, and phenol-formaldehyde resins; and organic photoconductive polymers such as poly-N-vinylcarbazole, polyvinylanthracene, and polyvinylperylene. Any one of these binder resins may be used alone, or any desired combination of two or more thereof may be used as a mixture thereof.

The solvent to be used for producing the coating fluid so as to form the charge generation layer is not particularly limited so long as the binder resin dissolves therein. Examples thereof include saturated aliphatic solvents such as pentane, hexane, octane, and nonane, aromatic solvents such as toluene, xylene, and anisole, amide solvents such as dimethylformamide and N-methyl-2-pyrrolidone, alcohol solvents such as methanol, ethanol, isopropanol, n-butanol, and benzyl alcohol, aliphatic polyhydric alcohols such as glycerin and polyethylene glycol, chain or cyclic ketone solvents such as acetone, cyclohexanone, and methyl ethyl ketone, ester solvents such as methyl formate, ethyl acetate, and n-butyl acetate, chain or cyclic ether solvents such as diethyl ether, dimethoxyethane, tetrahydrofuran, 1,4-dioxane, methyl Cellosolve, and ethyl Cellosolve, aprotic polar solvents such as acetonitrile, dimethyl sulfoxide, sulfolane, and hexamethylphosphoric triamide, nitrogen-containing compounds such as n-butylamine, isopropanolamine, diethylamine, triethanolamine, ethylenediamine, triethylenediamine, and triethylamine, mineral oils such as ligroin, and water. One of these solvents may be used alone, or two or more thereof may be used in combination. In the case where the undercoat layer described above is disposed, solvents in which this undercoat layer does not dissolve are preferred.

In the charge generation layer, the mixing ratio (mass ratio) of the binder resin and the charge generation substance is in such a range that the amount of the charge generation substance per 100 parts by mass of the binder resin is usually equal to or larger than 10 parts by mass, preferably equal to or larger than 30 parts by mass, and is usually equal to or less than 1,000 parts by mass, preferably equal to or less than 500 parts by mass. The film thickness of the charge generation layer is usually equal to or larger than 0.1 μm, preferably equal to or larger than 0.15 μm, and is usually equal to or less than 10 μm, preferably equal to or less than 0.6 μm. In case where the proportion of the charge generation substance is too high, there is a possibility that the stability of the coating fluid might decrease due to aggregation of the charge generation substance. Meanwhile, in case where the proportion of the charge generation substance is excessively low, there is a possibility of resulting in a decrease in the sensitivity of the photoreceptor.

For dispersing the charge generation substance, known dispersing techniques can be used, such as a ball mill dispersion method, an attritor dispersion method, a sand mill dispersion method, a beads mill dispersion method, and an ultrasonic dispersion method. In this case, it is preferred to finely reduce the particles to a particle size of 0.3 μm or less, preferably 0.2 μm or less, more preferably 0.1 μm or less.

1-4. Charge Transport Layer

The charge transport layer contains the charge transport substance and a binder resin and may further contain other ingredients which are used as necessary. Such a charge transport layer can be obtained by dissolving or dispersing the charge transport substance and the like, and a binder resin in a solvent to produce a coating fluid, applying this coating fluid on the charge generation layer, and drying the coating fluid applied. The film thickness of the charge transport layer is typically in a range of 5 μm to 50 μm, and preferably in a range of 10 μm to 45 μm.

The charge transport substance is not particularly limited and any substance can be used. Examples of the charge transport substance include heterocyclic compounds such as carbazole derivatives, indole derivatives, imidazole derivatives, oxazole derivatives, pyrazole derivatives, thiadiazole derivatives, and benzofuran derivatives; aniline derivatives, hydrazone derivatives, aromatic amine derivatives, stilbene derivatives, butadiene derivatives, enamine derivatives, and combination of plural kinds of these compounds, or a polymer having a group composed of these compounds in the main chain or side chain. Among them, carbazole derivatives, aromatic amine derivatives, stilbene derivatives, butadiene derivatives, enamine derivatives, and combination of plural kinds of these compounds are preferably used. The specific examples of the preferred structure of the charge transport substance will be described below. Hereinafter, the following specific examples are shown for the sake of the description, and any known charge transport substance may be used as long as it does not contradict the gist of the present invention.

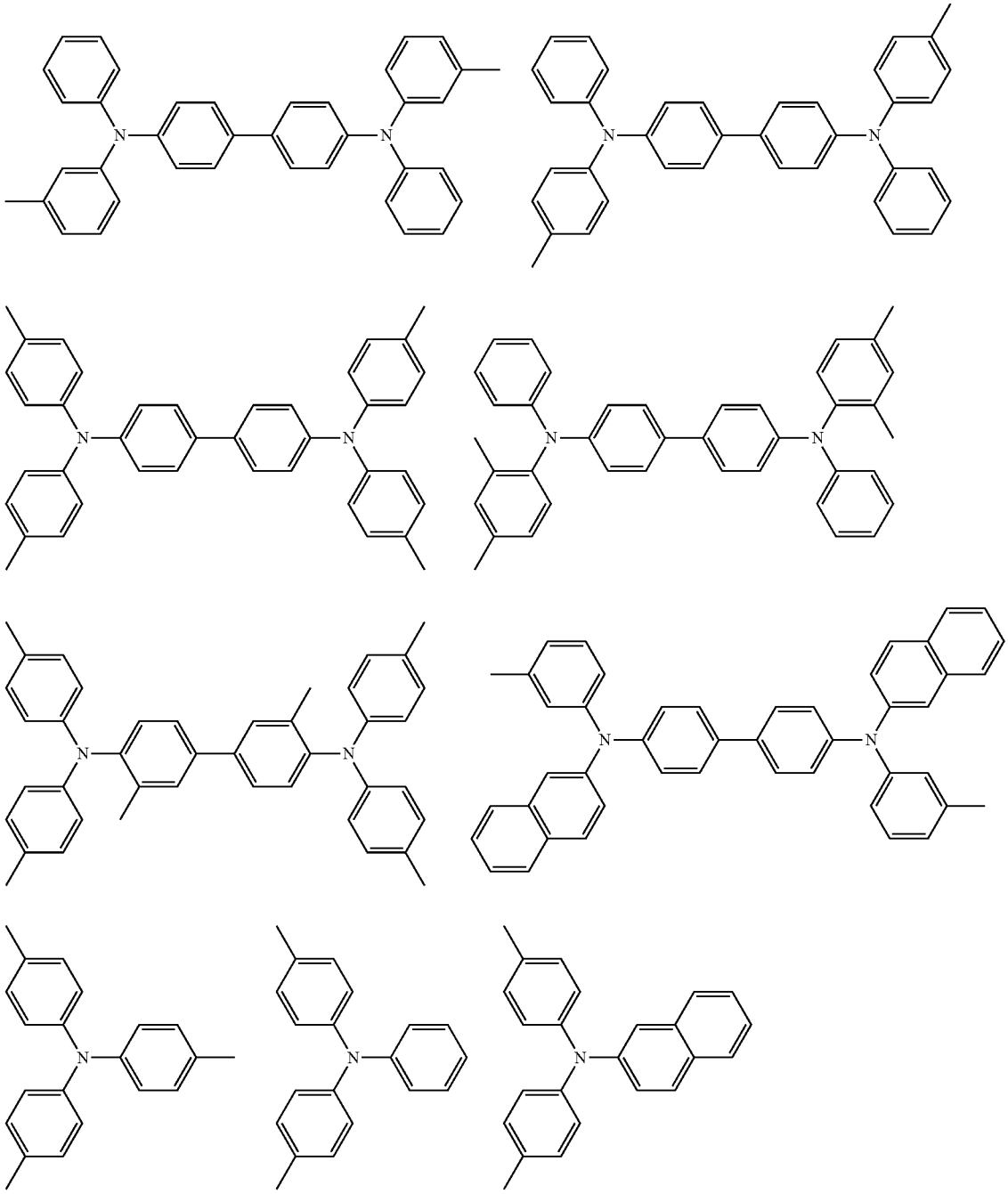

-continued
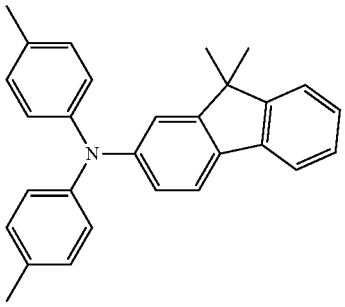
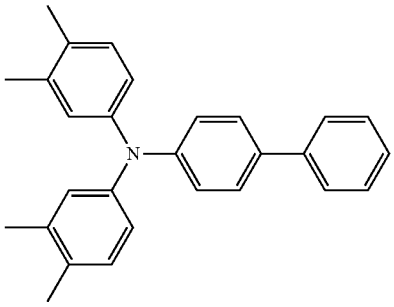
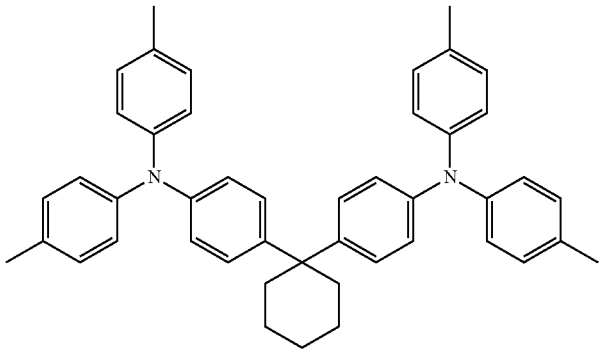
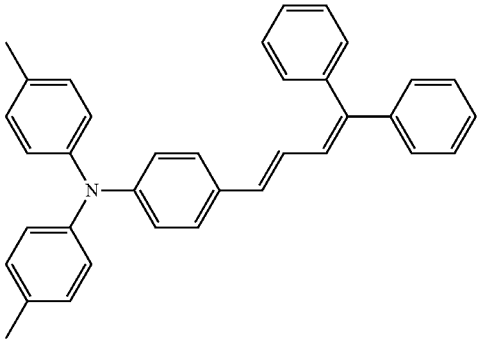
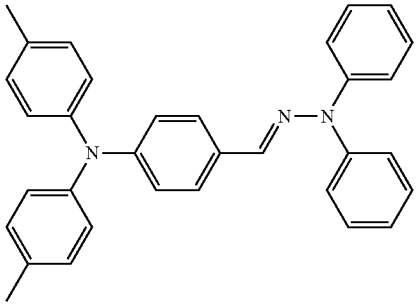
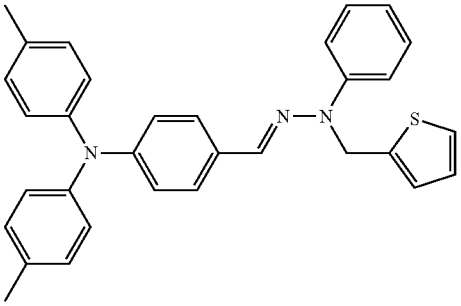
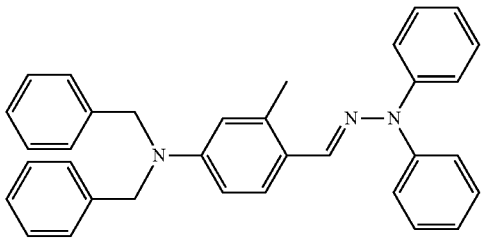
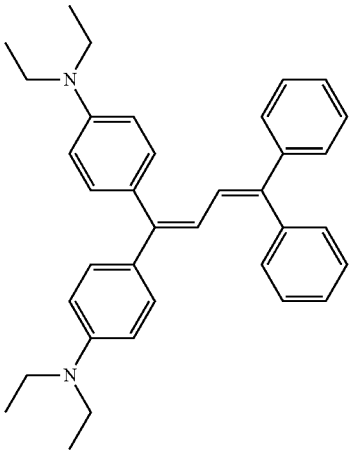

-continued
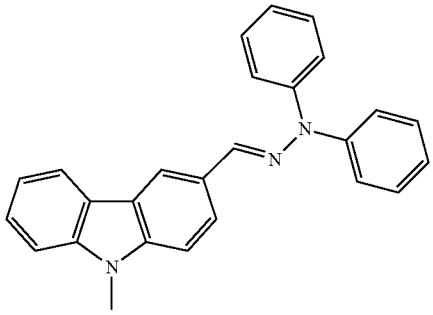
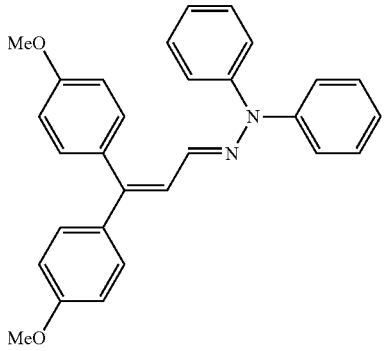
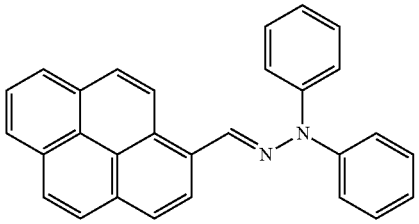
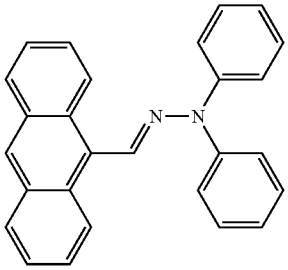
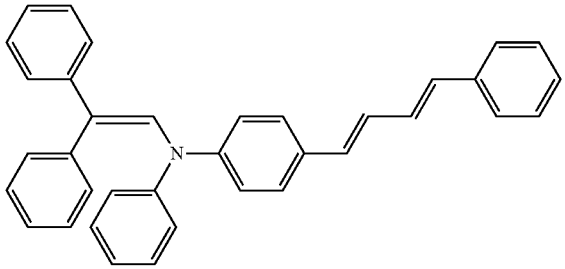
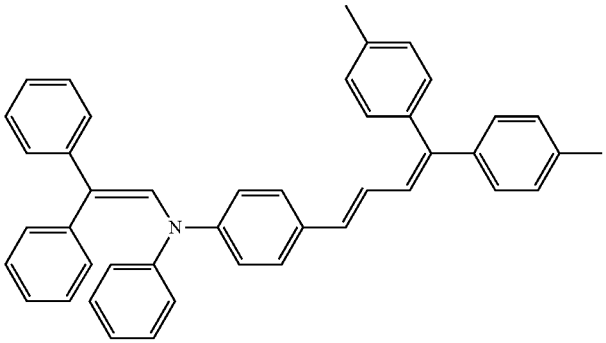
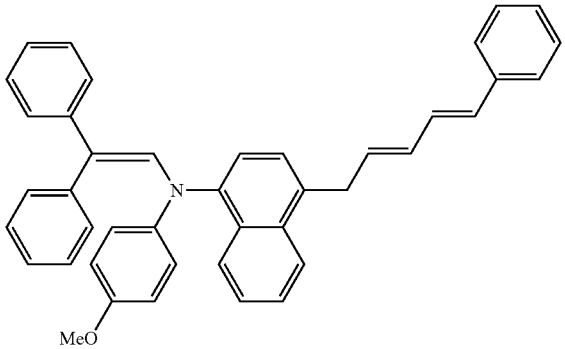
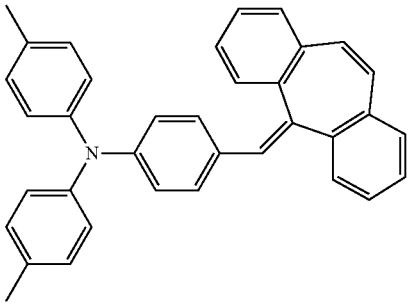
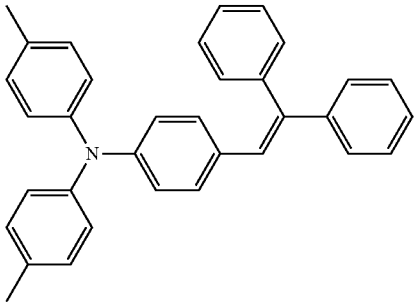
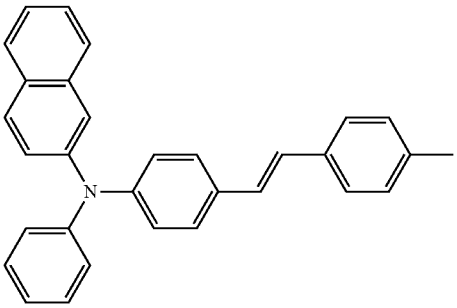
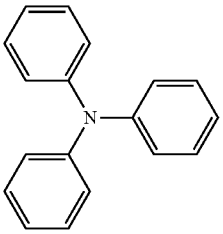

-continued
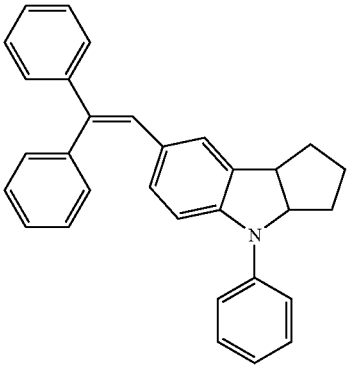
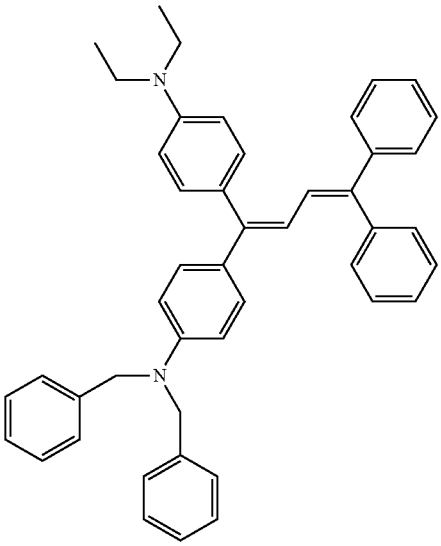
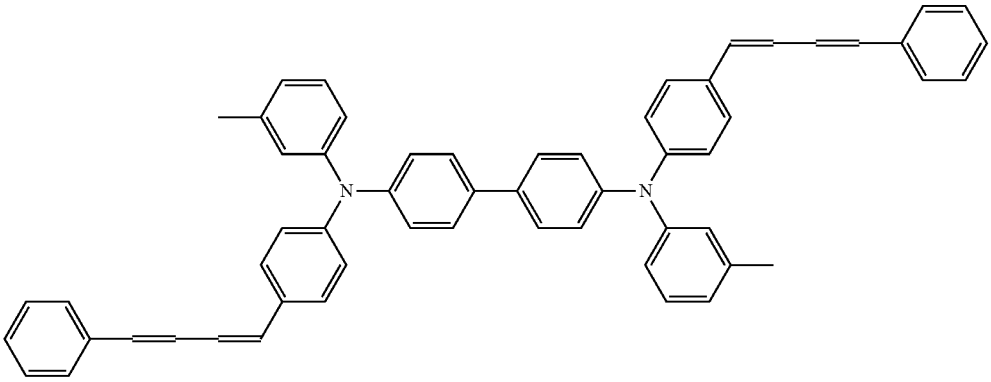
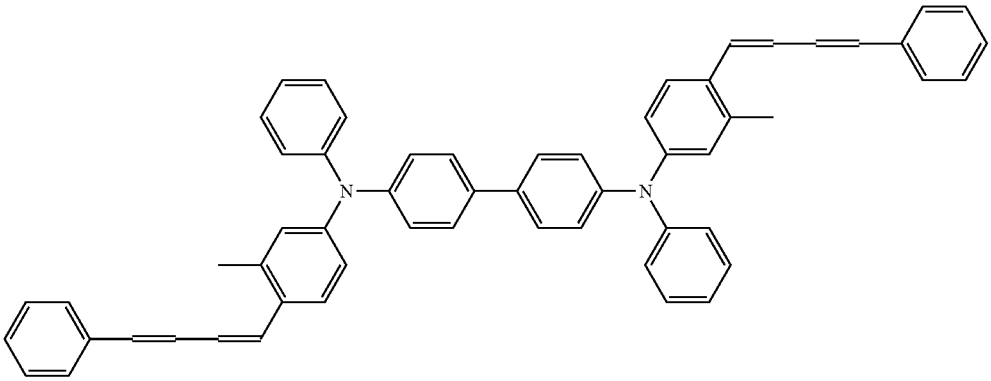
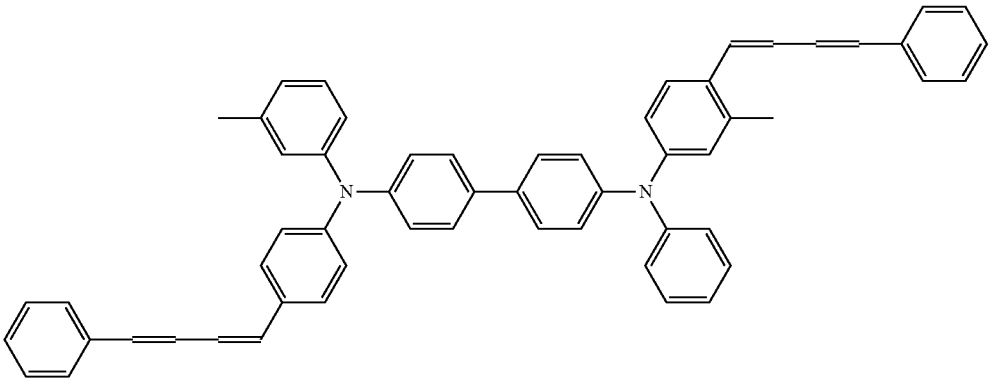

-continued
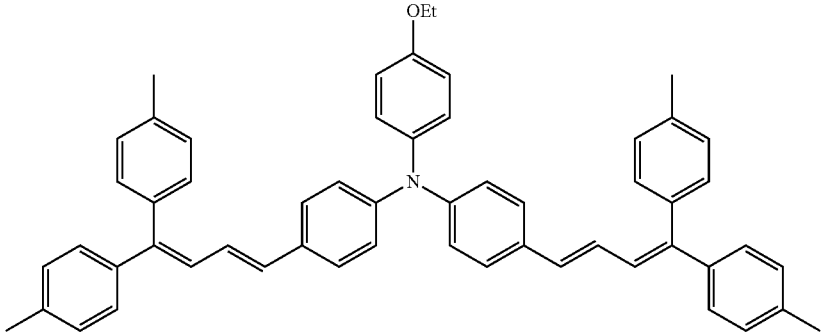
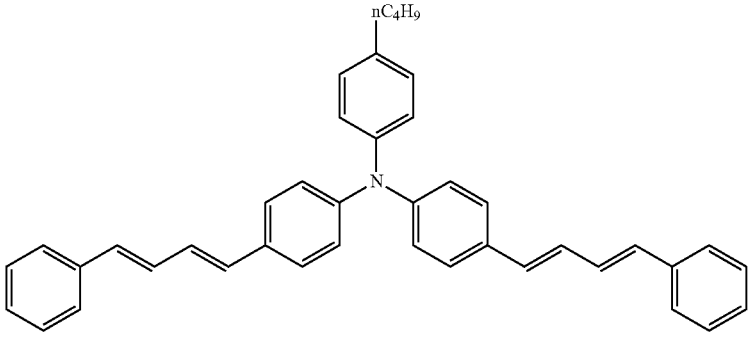
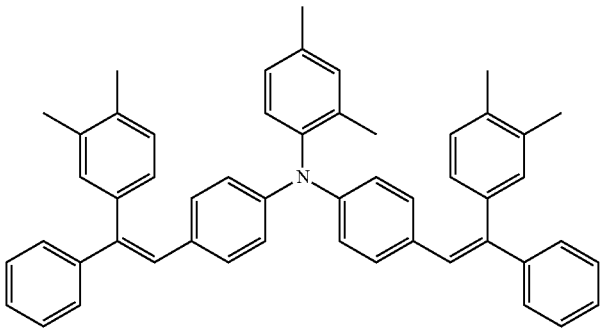
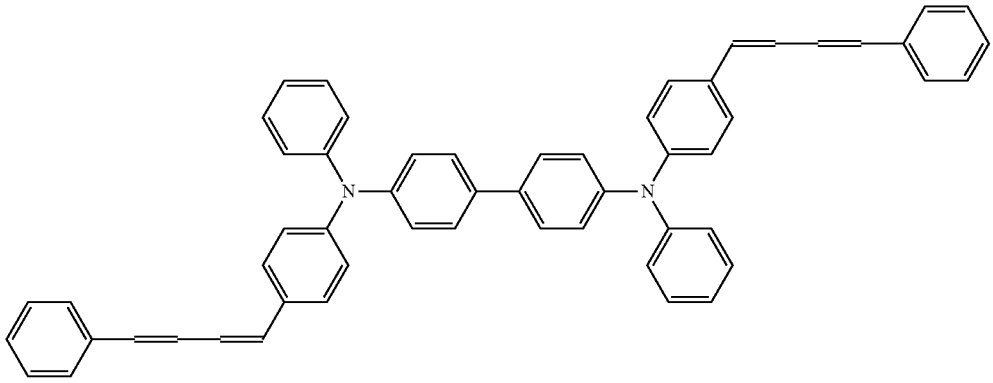

-continued
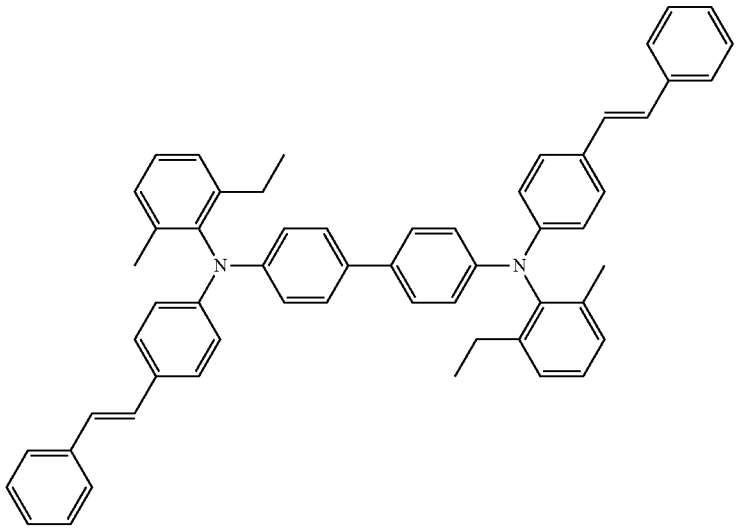
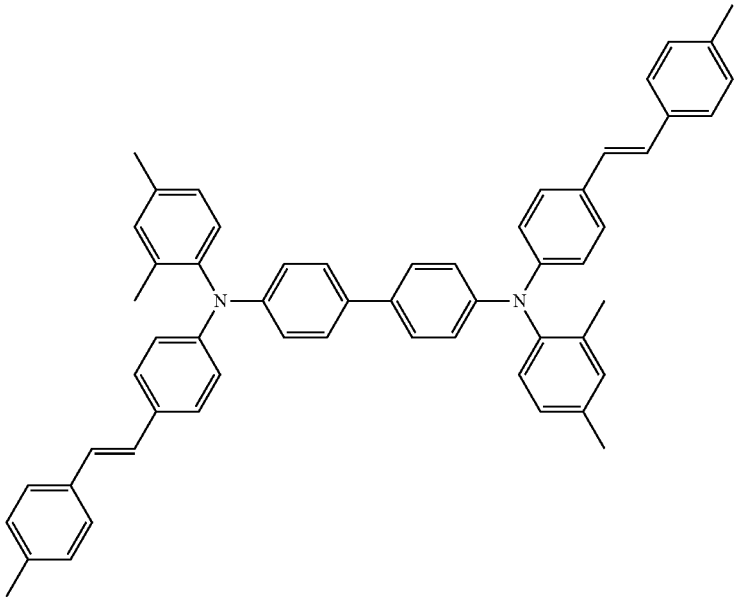
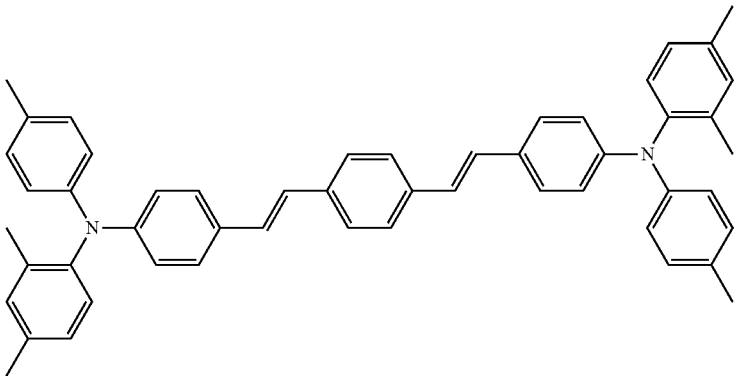

-continued

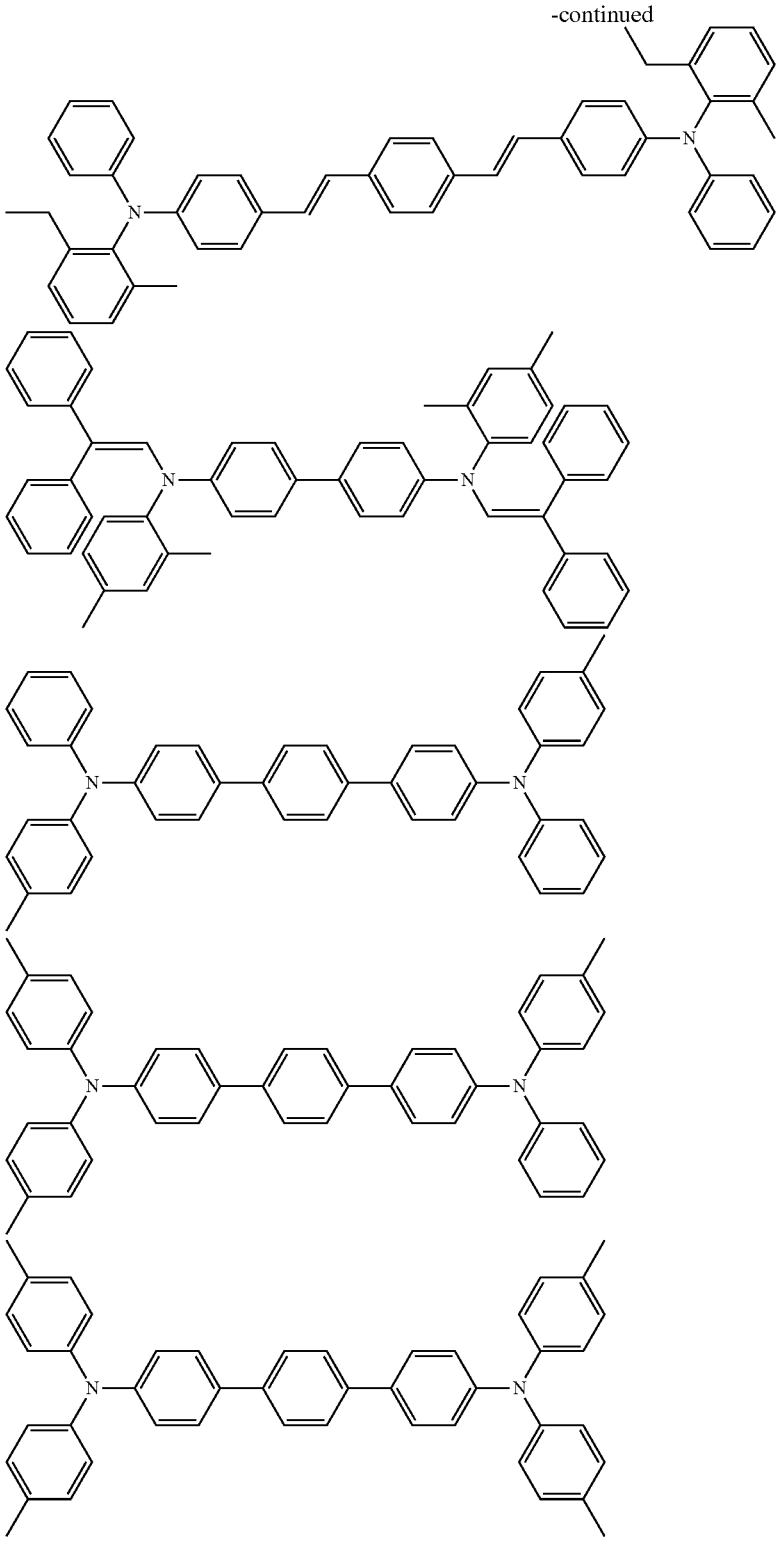

In addition, examples of the binder resin include vinyl polymers such as polymathic methacrylate, polystyrene, and polyvinyl chloride, or a copolymer thereof; and a thermoplastic resin such as a polycarbonate resin, a polyester resin, a polyarylate resin, a polyester polycarbonate resin, a polysulfate resin, a phenoxy resin, an epoxy resin, and a silicon resin, or various thermosetting resins. Among these resins, from the standpoint of electrical and mechanical properties, the polycarbonate resin and the polyarylate resin are preferable, and the polyarylate resin is more preferable.

With respect to the ratio of the binder resin and the charge generation substance, the proportion of the charge transport substance per 100 parts by mass of the binder resin is usually equal to or larger than 10 parts by mass. Among them, the amount thereof is preferably equal to or larger than 20 parts by mass from the standpoint of lowering residual potential, and is more preferably equal to or larger than 30 parts by mass from the standpoints of stability in repeated use and of charge mobility. On the other hand, from the standpoint of the thermal stability of the photosensitive layer, the proportion of the charge transport substance is usually equal to or less than 120 parts by mass. Among them, the amount thereof is equal to or less than 100 parts by mass from the standpoint of compatibility between the charge transport substance and the binder resin, more preferably equal to or less than 70 parts by mass from the standpoint of heat resistance, even more preferably equal to or less than 50 parts by mass from the standpoint of scratch resistance.

Known additives such as a plasticizer, an antioxidant, an ultraviolet absorber, an electron-attracting compound, fillers such as dyes, pigments, and organic/inorganic particles, and a leveling agent may be incorporated into charge transport layer, for the purpose of improving film-forming properties, flexibility, applicability, nonfouling properties, gas resistance, light resistance, and the like. Examples of the antioxidant include a hindered phenol compound and a hindered amine compound. In addition, examples of dyes and pigment include various dye compounds and azo compounds.

As the coating fluid for forming the charge transport layer, the organic solvent is selected from the standpoints of solubility of constituent components, uniformity of coated film, low harmfulness. In the present invention, a non-halogen organic solvent of the high boiling point is used, particularly, in a case of dip coating, with single use of the high boiling point solvent, it may be difficult to eliminate thickness uniformity, particularly and the film thickness difference in the vertical direction, and thus a low boiling point solvent may be used together.

Examples of the low boiling point solvent to be used in combination include ethers such as tetrahydrofuran (boiling point: 66° C.), 1,4-dioxane (boiling point: 101° C.), and dimethoxyethane (boiling point: 85° C.), esters such as ethyl formate (boiling point: 54° C.) and ethyl acetate (boiling point: 77° C.), ketones such as methyl ethyl ketone (boiling point: 80° C.), and methyl isobutyl ketone (boiling point: 116° C.), aromatic hydrocarbons such as toluene (boiling point: 111° C.), and chlorinated hydrocarbons such as dichloromethane (boiling point: 40° C.), chloroform (boiling point: 61° C.), 1,2-dichloroethane (boiling point: 84° C.), 1,1,2-trichloroethane (boiling point: 114° C.), 1,1,1-trichloroethane (boiling point: 74° C.), 1,2-dichloropropane (boiling point: 95° C.), and trichloroethylene (boiling point: 87° C.). The boiling point of these solvents is preferably in a range of 50° C. to 130° C. from the standpoint of homogeneity of the coating film, and is more preferably in a range of 60° C. to 120° C. from the standpoint of production efficiency. In addition, as the low boiling point solvent, not only one type but also two or more types may be mixed to be used.

From the standpoint of environmental safety, a non-halogen solvent is preferable. Examples of the high boiling point non-halogen organic solvent which has the boiling point of 140° C. or more include o-xylene (boiling point: 144° C.), dibutyl ether (boiling point: 142° C.), di-n-hexyl ether (boiling point: 227° C.), butyl phenyl ether (boiling point: 210.2° C.), anisole (boiling point: 154° C.), phenetol (boiling point: 172° C.), 4-methylanisole (boiling point: 174° C.), ethyl benzyl ether (boiling point: 186° C.), diphenyl ether (boiling point: 259° C.), dibenzyl ether (boiling point: 297° C.), 1,4-dimethoxybenzene (boiling point: 213° C.), cineole (boiling point: 176° C.), 1,2-dibutoxyethane (boiling point: 203° C.), diethylene glycol dimethyl ether (boiling point: 162° C.), diethylene glycol ethyl methyl ether (boiling point: 179° C.), ethylene glycol diethyl ether (boiling point: 189° C.), triethylene glycol dimethyl ether (boiling point: 216° C.), dipropylene glycol dimethyl ether (boiling point: 175° C.), diethylene glycol diethyl ether (boiling point: 188° C.), diethylene glycol dibutyl ether (boiling point: 256° C.), 2-heptanone (boiling point: 151.5° C.), 4-heptanone (boiling point: 143.7° C.), acetylacetone (boiling point: 140.4° C.), diisobutyl ketone (boiling point: 163° C.), acetonylacetone (boiling point: 191° C.), phorone (boiling point: 198° C.), acetophenone (boiling point: 202° C.), isophorone (boiling point: 215.3° C.), cyclohexanone (boiling point: 155.6° C.), methylcyclohexanone (boiling point: 169° C.), benzyl acetate (boiling point: 212° C.), pentyl acetate (boiling point: 149.2° C.), isobutyl acetate (boiling point: 142.1° C.), 3-methoxybutyl acetate (boiling point: 172° C.), 2-ethylbutyl acetate (boiling point: 160° C.), 2-ethylhexyl acetate (boiling point: 198.6° C.), cyclohexyl acetate (boiling point: 172° C.), benzyl acetate (boiling point: 215.5° C.), methyl benzoate (boiling point: 199.6° C.), ethyl benzoate (boiling point: 212° C.), butyl propionate (boiling point: 146.8° C.), isopentyl propionate (boiling point: 160.7° C.), butyl butyrate (boiling point: 166.6° C.), isopentyl butyrate (boiling point: 184.8° C.), diethyl oxalate (boiling point: 188.5° C.), diethyl malonate (boiling point: 199.3° C.), dimethyl phthalate (boiling point: 283° C.), methyl salicylate (boiling point: 222° C.), ethyl 3-ethoxypropionate (boiling point: 166° C.), ethylene glycol monomethyl ether acetate (boiling point: 145° C.), ethylene glycol monoethyl ether acetate (boiling point: 156.3° C.), propylene glycol monomethyl ether acetate (boiling point: 146° C.), ethylene glycol monobutyl ether acetate (boiling point: 192° C.), ethylene glycol monohexyl ether acetate (boiling point: 208.3° C.), diethylene glycol monoethyl ether acetate (boiling point: 217.4° C.), γ-butyrolactone (boiling point: 204° C.), ethylene carbonate (boiling point: 260.7° C.), propylene carbonate (boiling point: 240° C.), cumene (boiling point: 152.4° C.), tetralin (boiling point: 207.5° C.), butyl benzene (boiling point: 183.3° C.), t-butylbenzene (boiling point: 169° C.), p-cymene (boiling point: 177.1° C.), cyclohexyl benzene (boiling point: 238.9° C.), o-diethylbenzene (boiling point: 183.5° C.), pentylbenzene (boiling point: 205° C.), dodecylbenzene (boiling point: 288° C.), nonane (boiling point: 150.8° C.), decane (boiling point: 174.2° C.), N-methylpyrrolidone (boiling point: 202° C.), nitrobenzene (boiling point: 210.9° C.), sulfolane (boiling point: 285° C.), and 4-methoxy-4-methyl-2-penthanone (boiling point: 156° C.).

Among them, the boiling point is preferably equal to or greater than 150° C., and is more preferably equal to or greater than 165° C. from the standpoint of the stability of electrical properties, adhesion, and productivity. In addition, the boiling point is preferably equal to or less than 250° C., and more preferably equal to or less than 230° C. Specifically, methyl benzoate, ethyl benzoate, benzyl acetate, ethyl 3-ethoxypropionate, and diethylene glycol ethyl methyl ether, and 4-methoxy-4-methyl-2-pentanone are more preferable, and methyl benzoate is particularly preferable. Note that, halogen type high boiling point solvent is environmentally concerned, and residues after drying adversely affect the electrical properties of the photoconductor, and thus it is preferable not to use them together.

The optimal range of the mixing ratio in a case of mixing the low boiling point solvent with the high boiling point solvent is not fixed in dependent of the boiling point of the solvent to be used; however, the mass fraction of low boiling point solvent is preferably in a range of 30% to 95%, and is more preferably in a range of 50% to 90%.

In a case where the high boiling point solvent is only used without using the low boiling point solvent, the mass fraction of the solvent having the boiling point of equal to or lower than 160° C. is preferably equal to or greater than 50%, and is more preferably equal to or greater than 70%.

1-5. Other Functional Layers

Another layer which is further provided on the multilayer type photoreceptor may be an uppermost surface layer. For example, a protective layer may be disposed for the purpose of preventing the photosensitive layer from being damaged or wearing or of preventing or lessening the deterioration of the photosensitive layer caused by, for example, discharge products generated from the charging device or the like. The protective layer is formed by containing the conductive material in an appropriate binder resin, or can be formed of a copolymer using a compound such as a triphenylamine skeleton having a charge transporting ability.

The conductive material used for the protective layer is not particularly limited, and examples thereof include a metal oxide such as an aromatic amino compound, antimony oxide, indium oxide, tin oxide, titanium oxide, tin oxide-antimony oxide, aluminum oxide, and zinc oxide.

Examples of the binder resin used for the protective layer include well-known resins such as a polyamide resin, a polyurethane resin, a polyester resin, a polyarylate resin, an epoxy resin, a polyketone resin, a polycarbonate resin, a polyvinyl ketone resin, a polystyrene resin, a polyacrylamide resin, and a siloxane resin, and an acrylic monomer such as a triphenylamine skeleton having a charge transporting ability can be also used by being polymerized alone, or being copolymerized with the above-described resins.

Typically, the electric resistance of the protective layer is preferably in a range of $10^9$ Q·cm to $10^{14}$ Q·cm. When the electric resistance becomes higher than the above-described range, there is a possibility that the residual potential is increased and an image is formed with many fogs. On the other hand, when the electric resistance becomes lower than the above-described range, there is a possibility that blurring of an image and resolution reduction may occur. Further, it is preferable that the protective layer is configured so as not to substantially interfere with the transmission of light irradiated at the time of image exposure.

In addition, in order to reduce the frictional resistance of the photoreceptor surface and the friction, and to increase the transfer efficiency of the toner from the photoreceptor to the transfer belt or paper, a fluorine resin, a silicon resin, and a polyethylene resin may be contained in the surface layer, or the particles formed of these resins or particles of inorganic compounds may be contained in the surface layer. Alternatively, a layer containing these resins or particles may be newly formed as a surface layer.

2. Method of Manufacturing Electrophotographic Photoreceptor

A method of manufacturing an electrophotographic photoreceptor includes a step of forming hydroxygallium phthalocyanine which is synthesized by using a non-halogen solvent, and a charge generation layer by using a coating fluid containing a binder resin, and a step of forming a charge transport layer by using the coating fluid containing the non-halogen organic solvent of which the boiling point is 140° C. or more. The layers for constituting the photoreceptor are formed in the following manner. The substances to be incorporated into each layer are dissolved or dispersed in a solvent to obtain a coating fluid. The coating fluids thus obtained for the respective layers are successively applied on the support by a known technique such as a dip coating method, a ring coating method, a spray coating method, a nozzle coating method, a bar coating method, a roll coating method, and a blade coating method. By repeating this application/drying step for each layer, the constituent layers are formed. Among those methods, the dip coating method and the ring coating method are preferable from the standpoint of homogeneity of the coating film, and the dip coating method is particularly preferable from the standpoint of mass productivity.

In the dip coating method, a coated film is formed on the surface by relatively moving a container accommodating the coating fluid and a substrate to be coated, and dipping the substrate into the coating fluid and then pulling up. In general, a method in which the photosensitive substrate is allowed to stand for a certain period of time to be naturally dried after pulling up the substrate is adopted.

In order to form a coated film having a certain thickness by using the dip coating method, typically, a quick-drying low boiling point solvent is used as the solvent of the coating fluid. In a case where the quick-drying low boiling point solvent is only used, it is possible to solidify the coating fluid in a short time by increasing the drying speed of the coating fluid; however, there is a disadvantage that the surface property of the formed coated film is deteriorated for the following reason.

That is, a flow of solvent vapor generated by surrounding extremely low speed air flow imparts thickness unevenness to the coated film to be formed. Particularly, this phenomenon occurs remarkably in an industrial scale implementation in which a large number of substrates are suspended. Due to large influence of the solvent vapor generated from the coating fluid with which the substrates which are adjacent to each other are coated, the influence of solvent vapor to be received is different between a photosensitive substrate positioned at the end and a photosensitive substrate at a position where the periphery thereof is surrounded by another photosensitive substrate, and thus the thickness unevenness of the photosensitive coated film is likely to occur. In addition, particularly, when the charge transport layer is coated, if the drying speed is excessively fast, a coating defect called blushing (a phenomenon in which water vapor condenses on a coated film that has deprived latent heat due to rapid evaporation of the solvent and the photosensitive coated film becomes opaque) is likely to occur.

In order to solve the above-described problem, it is preferable to employ a method in which the low boiling point solvent and the high boiling point non-halogen organic solvent are used in combination, and the coated substrate is allowed to stand still and allowed to air dry in a space of which the vicinity is covered with a hood. In addition, in a case where the solvent vapor is excessively accumulated in the shield space, the drying speed becomes excessively slow, dripping is caused and thickness unevenness occurs in the vertical direction of the photosensitive substrate, and thus the concentration of the solvent vapor in the shield space is usually controlled. In a case where non-halogen organic solvent at a high boiling point which is 140° C. or more is used, since dripping phenomenon becomes more remarkable, the solvent vapor is not excessively accumulated, and thus it is preferable to have an appropriate natural drying step.

Hereinafter, as an example of the embodiment of the above-described dip coating method, a preferred suitable adjustment range of the coating fluid will be described. The amount of the solvent or dispersion medium to be used is not particularly limited. It is, however, preferred to suitably regulate the amount thereof so that the properties of the coating fluid, such as solid concentration and viscosity, are within desired ranges, while taking account of the purpose of each layer and the nature of the selected solvent or dispersion medium.

In a case of forming the charge generation layer, the solid concentration of the coating fluid is usually equal to or higher than 0.1% by mass, and preferably equal to or higher than 1% by mass, and is usually equal to or less than 15% by mass, and preferably equal to or less than 10% by mass. Further, the viscosity of the coating fluid is usually equal to or greater than 0.01 cps, and preferably equal to or greater than 0.1 cps, and is usually equal to or less than 20 cps, and preferably equal to or less 10 cps.

In a case of forming the charge transport layer, the coating fluid the solid concentration of each coating fluid is usually equal to or greater than 5% by mass, preferably equal to or greater than 10% by mass, and is usually equal to or less than 40% by mass, preferably equal to or less than 35% by mass. Furthermore, the viscosity of this coating fluid, is usually equal to or higher than 10 cps, preferably equal to or higher than 50 cps, and is usually equal to or less than 500 cps or, preferably equal to or less than 400 cps.

The drying of the coating fluid is performed whenever each layer is coated. Here, in a case of the undercoat layer and the charge generation layer, when using the low boiling point solvent, the process can proceed to the next upper layer coating step with only natural drying without performing heat drying. In the case of the charge transport layer, the solvent evaporates to some extent at usual room temperature, but in the case of using the high-boiling point solvent as in the present application, the heat drying is essentially performed. The drying may be performed at a constant temperature, and may be performed by changing a drying temperature in a plurality of stages. Regarding the drying temperature, it is preferable to perform heat drying at a temperature usually in the range of 50° C. to 200° C. for a period of 10 minutes to 2 hours, preferably for a period of 15 minutes to 60 minutes, stationarily or with air blowing. If the drying time is excessively short, the residual solvent is increased, and thereby the electrical properties and the image properties are deteriorated. Further, if the drying time is excessively long, a portion of the photosensitive layer component may be deteriorated by air oxidation. The residual amount of the non-halogen organic solvent at a temperature equal to or higher than 140° C. in the charge transport layer per unit area is in a range of 0.1 $\mu g/cm^2$ to 5 $\mu g/cm^2$, and is preferably equal to or greater than 0.2 $\mu g/cm^2$ from the standpoint of suppression of photosensitive layer deterioration, and is preferably equal to or less than 2 $\mu g/cm^2$ from the standpoint of the electrical properties.

3. Image Forming Apparatus

Next, an embodiment of an image forming apparatus (the image forming apparatus of the present invention) by using an electrophotographic photoreceptor of the present invention will be described with reference to FIG. 1 illustrating main components of the apparatus. In this regard, the embodiment is not limited to the following description, and can be performed by various modifications without departing from the gist of the present invention.

As illustrated in FIG. 1, the image forming apparatus is configured so as to be equipped with an electrophotographic photoreceptor 1, a charging device 2, an exposure device 3, and a developing device 4. The apparatus is further provided with a transfer device 5, a cleaner 6, and a fixing device 7 as necessary.

The electrophotographic photoreceptor 1 is not particularly limited as long as it is the electrophotographic photoreceptor of the invention described above. In FIG. 1, as an example thereof, a drum-shaped photoreceptor obtained by forming the photosensitive layer described above on the surface of a cylindrical conductive support is illustrated. The charging device 2, the exposure device 3, the developing device 4, the transfer device 5, and the cleaner 6 have been disposed along the peripheral surface of this electrophotographic photoreceptor 1.

Figure 2:
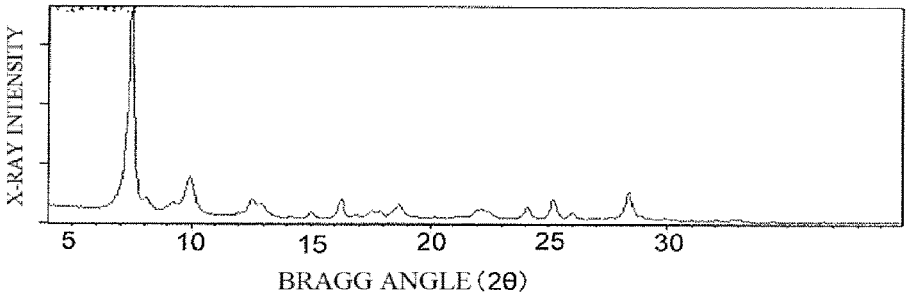
FIG. 2 is an X-ray diffraction diagram of a hydroxygallium phthalocyanine (A) described in Preparing Example 1 of the present invention.

The charging device 2 serves to charge the electrophotographic photoreceptor 1. This device evenly charges the surface of the electrophotographic photoreceptor 1 to a given potential. The frequently used charging device is a non-contact type corona charging device, such as a corotron or a scorotron, or a contact type charging device (direct charging device) in which a direct charging member to which a voltage is being applied is brought into contact with the photoreceptor surface to charge the surface. Examples of the contact-type charging device include charging rollers and charging brushes. Note that, FIG. 2 illustrates a roller type charging device (charging roller) as an example of the charging device 2. Typically, the charging roller is manufactured by integrally molding additives such as a resin and a plasticizer with a metal shaft, and may have a laminated structure as necessary. As a voltage to be applied at the time of charging, it is possible to use only a direct current voltage, or to superimpose an alternating current on the direct current.

The exposure device 3 conducts exposure on the electrophotographic photoreceptor 1, and is not particularly limited to the types thereof as long as an electrostatic latent image can be formed on the photosensitive surface of the electrophotographic photoreceptor 1. Specific examples thereof include halogen lamps, fluorescent lamps, lasers such as semiconductor lasers and He—Ne lasers, and LEDs. It is also possible to conduct exposure by the technique of internal photoreceptor exposure. Any desired light may be used for exposure. For example, monochromatic light having a wavelength of 780 nm, monochromatic light having a slightly short wavelength of 600 nm to 700 nm, monochromatic light having a short wavelength of 380 nm to 500 nm, or the like may be used to conduct exposure.

The type of the toner T is not limited, and a polymerization toner or the like obtained by suspension polymerization, emulsion polymerization, and the like can be used besides a powdery toner. Particularly when a polymerization toner is used, this toner preferably is one having a small particle diameter of about 4-8 μm. The toner particles to be used can have any of various shapes ranging from a shape close to sphere to a shape which is not spherical, such as a potato shape. Polymerization toners are excellent in terms of evenness of charging and transferability and are suitable for image quality improvement.

The transfer device 5 is not particularly limited to the type thereof, and use can be made of a device operated by any desired technique selected from an electrostatic transfer technique, a pressure transfer technique, an adhesive transfer technique, and the like, such as, for example, corona transfer, roller transfer, and belt transfer. Here, the transfer device 5 is a device configured of a transfer charger, a transfer roller, a transfer belt, or the like disposed so as to face the electrophotographic photoreceptor 1. A given voltage value (transfer voltage) which has the polarity opposite to that of the charge potential of the toner T is applied to the transfer device 5, and this transfer device 5 thus serves to transfer the toner image formed on the electrophotographic photoreceptor 1 to recording paper (paper or medium) P.

There are no particular limitations on the cleaner 6, and any desired cleaner can be used, such as a brush cleaner, a magnetic brush cleaner, an electrostatic brush cleaner, a magnetic roller cleaner, or a bladed cleaner. The cleaner 6 serves to scrape off the residual toner adherent to the photoreceptor 1 with a cleaning member and thus recovers the residual toner. However, when there is little or substantially no toner adherent to the surface of the photoreceptor, the cleaner 6 may be omitted.

In the electrophotographic apparatus having the configuration described above, image recording is conducted in the following manner. First, the surface (photosensitive surface) of the photoreceptor 1 is charged to a given potential (e.g., 600 V) by the charging device 2. In this case, this charging may be conducted with a direct-current voltage or with a direct-current voltage on which an alternating-current voltage has been superimposed.

Subsequently, the charged photosensitive surface of the photoreceptor 1 is exposed to light by the exposure device 3 in accordance with the image to be recorded. Thus, an electrostatic latent image is formed on the photosensitive surface. This electrostatic latent image formed on the photosensitive surface of the photoreceptor 1 is developed by the developing device 4.

In the developing device 4, toner T fed by the feed roller 43 is spread into a thin layer with the control member (developing blade) 45 and, simultaneously therewith, frictionally charged so as to have given polarity (here, the toner is charged so as to have positive polarity, which is the same as the polarity of the charge potential of the photoreceptor 1). This toner T is conveyed while being held by the developing roller 44 and is brought into contact with the surface of the photoreceptor 1.

When the charged toner T held on the developing roller 44 comes into contact with the surface of the photoreceptor 1, a toner image corresponding to the electrostatic latent image is formed on the photosensitive surface of the photoreceptor 1. This toner image is transferred to recording paper P by the transfer device 5. Thereafter, the toner which has not been transferred and remains on the photosensitive surface of the photoreceptor 1 is removed by the cleaner 6.

After the transfer of the toner image to the recording paper P, this recording paper P is passed through the fixing device 7 to thermally fix the toner image to the recording paper P. Thus, a finished image is obtained.

Incidentally, the image forming apparatus may be configured so that an erase step, for example, can be conducted, besides the configuration described above. The erase step is a step in which the electrophotographic photoreceptor is exposure to light to thereby remove the residual charges from the electrophotographic photoreceptor. As an eraser, use may be made of a fluorescent lamp, LED, or the like. The light to be used in the erase step, in many cases, is light having such an intensity that the exposure energy thereof is at least 3 times that of the exposure light. From the standpoint of miniaturization and energy saving, it is preferable not to have the erase step.

In addition, the configuration of the image forming apparatus may be further modified. For example, the apparatus may be configured so that steps such as a pre-exposure step and an auxiliary charging step can be conducted therein, or may be configured so that offset printing is conducted therein. Furthermore, the apparatus may have a full-color tandem configuration in which a plurality of toners are used.

Incidentally, the electrophotographic photoreceptor 1 may be combined with one or more of the charging device 2, exposure device 3, developing device 4, transfer device 5, cleaner 6, and fixing device 7 to constitute an integrated cartridge (hereinafter suitably referred to as "electrophotographic photoreceptor cartridge"), and this electrophotographic photoreceptor cartridge may be used in a configuration in which the cartridge can be demounted from the main body of an electrophotographic apparatus, e.g., copier or laser beam printer.

EXAMPLES

Hereinafter, embodiments of the invention are explained below in more detail by reference to Examples. However, the invention is not limited to the following Examples unless the modifications depart from the spirit of the invention.

Synthesis of Hydroxygallium Phthalocyanine
Synthesis Example 1

34.6 g of 1,3-diiminoisoindoline and 10 g of gallium trichloride were put into 200 ml of dimethylsulfoxide and reacted at 160° C. for 4 hours. After the reaction solution was cooled to room temperature, 4.6 g of 5.0% by mass sodium hypochlorite aqueous solution was added thereto. The reaction solution was separated by filtration, and the obtained crystals were washed with 300 ml of methanol and 100 ml of ion exchanged water, and then dried so as to obtain 21.2 g of chlorogallium phthalocyanine. 4.0 g of obtained chlorogallium phthalocyanine was dissolved in 160 g of concentrated sulfuric acid at −10° C., and this solution was added dropwise to 1200 g of distilled water at 5° C. so as to precipitate crystals. After washing with distilled water, diluted ammonia water or the like, it was dried so as to obtain 3.6 g of hydroxygallium phthalocyanine.

2.0 g of the obtained hydroxygallium phthalocyanine was milled with 30 ml of dimethylformamide and 55 g of glass beads for 30 hours in a sand ground mill. After filtering, it was washed twice with 100 ml of methanol and dried to obtain 1.9 g of V-form hydroxygallium phthalocyanine (A). The powder X-ray diffraction pattern of the obtained hydroxygallium phthalocyanine (A) is illustrates in FIG. 2.

Synthesis Example 2

Under the nitrogen atmosphere, 32 g of O-phthalodinitrile and 10 g of gallium trichloride were put into 164 g of α-chloronaphthalene and reacted at 205° C. for 5 hours. The reaction solution was cooled to 150° C., filtered, and the obtained crystals were washed with 150 ml of N-methylpyrrolidone and 150 ml of methanol, and then dried to obtain 11.5 g of chlorogallium phthalocyanine.

Figure 3:
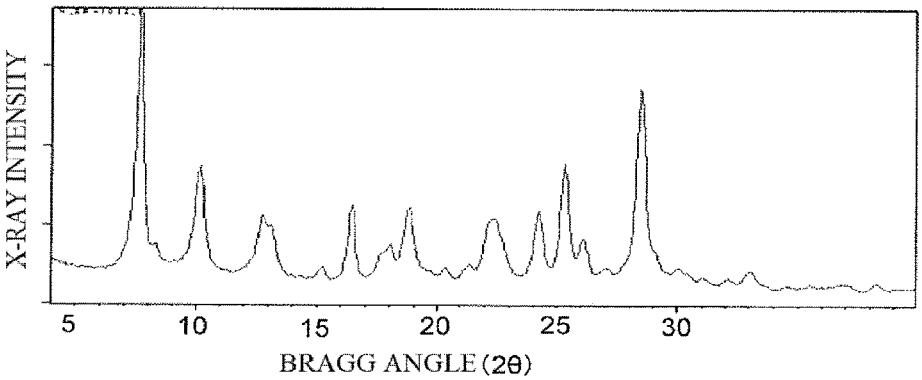
FIG. 3 is an X-ray diffraction diagram of hydroxygallium phthalocyanine (B) described in Preparing Example 2 of the present invention.

The obtained chlorogallium phthalocyanine was treated with concentrated sulfuric acid and milled in the same manner as in Synthesis Example 1 so as to obtain 1.9 g of V-form hydroxygallium phthalocyanine (B). The powder X-ray diffraction pattern of the obtained hydroxygallium phthalocyanine (B) is illustrates in FIG. 3. Manufacturing of photoreceptor

Example 1

Manufacturing of Coating Fluid

The coating fluid for an undercoat layer was prepared as follows. Rutile type titanium oxide having an average primary particle size of 40 nm ("TTO55N" manufactured by Ishihara Sangyo Kaisha, Ltd.) and 3% by mass of methyldimethoxysilane ("TSL8117" manufactured by Toshiba Silicone Co., Ltd.) with respect to the aforementioned titanium oxide are put into a high-speed fluid type mixing and kneading machine ("SMG300" manufactured by Kawata mfg. Co., Ltd.), and the surface treated titanium oxide obtained by high speed mixing at a circumferential rotation speed of 34.5 m/sec was dispersed by using a ball mill of methanol/1-propanol to prepare a dispersed slurry of hydrophobized titanium oxide. This dispersion slurry and a methanol/1-propanol/toluene mixed solvent were stirred and mixed, with heating, together with pellets of a copolyamide having a composition in which the ϵ-caprolactam [compound represented by the following formula (A)]/bis(4-amino-3-methylcyclohexyl)methane [compound represented by the following formula (B)]/hexamethylenediamine [compound represented by the following formula (C)]/decamethylenedicarboxylic acid [compound represented by the following formula (D)]/octadecamethylenedicarboxylic acid [compound represented by the following formula (E)] molar ratio was 75%/9.5%/3%/9.5%/3%. After the polyamide pellets were dissolved, this mixture was subjected to an ultrasonic dispersion treatment. Thus, a coating fluid for undercoat layer formation which had a methanol/1-propanol/toluene ratio of 7/1/2 by mass, contained the hydrophobized titanium oxide and the copolyamide in a mass ratio of 3/1, and had a solid concentration of 18.0% was obtained.

(A)

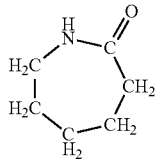

(B)

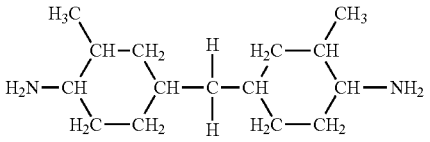

(C)

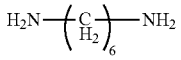

(D)

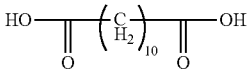

(E)

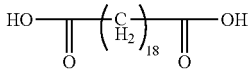

A coating liquid for forming a charge generation layer was prepared as follows. As a charge generation substance, 20 parts of hydroxygallium phthalocyanine (A) was mixed, with 280 parts of 1,2-dimethoxyethane which is prepared in Synthesis Example 1. This mixture was subjected to a pulverization/dispersion treatment in which the charge generation substance was pulverized for 1 hour with a sand grinding mill. Subsequently, the resultant fine dispersion was mixed with a binder solution obtained by dissolving 10 parts of polyvinyl butyral (trade name "Denka Butyral" #6000C, manufactured by Denki Kagaku Kogyo K.K.) in a liquid mixture composed of 255 parts of 1,2-dimethoxyethane and 85 parts of 4-methoxy-4-methyl-2-pentanone, and with 230 parts of 1,2-dimethoxyethane to prepare a coating fluid for charge generation layer formation.

The coating fluid for forming a charge transport layer was prepared as follows. As the charge transport substance, 40 parts by mass of compound represented by the following formula (CT1), 40 parts by mass of compound represented by the following formula (CT2), 100 parts by mass of polyarylate resin (terephthalic acid:isophthalic acid=50:50, and viscosity-average molecular weight: 40,000) formed of a structure unit represented by the following formula (PA1), and 0.05 parts by mass of silicone oil (trade name KF96, prepared by Shin-Etsu Silicones) were dissolved in 640 parts by mass of a mixed solvent of ortho-xylene/methyl benzoate (80% by mass of ortho-xylene, 20% by mass of methyl benzoate) to prepare a coating fluid for forming a charge transport layer.

Formula (CT1)

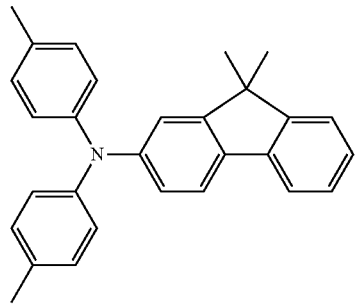

Formula (CT2)

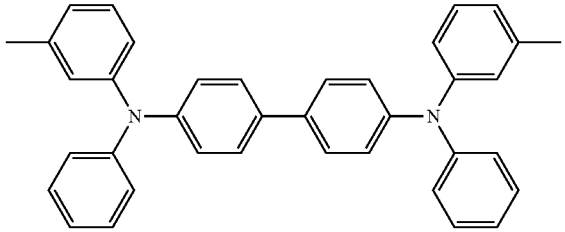

Formula (PA1)

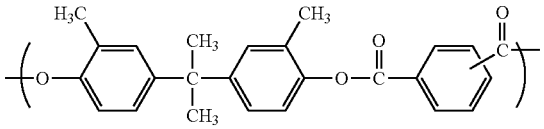

Manufacturing of Photoreceptor Drum

The coating fluid for forming a under coat layer, the coating fluid for forming a charge generation layer, and the coating fluid for forming a charge transport layer were successively applied, by using a dip coating method, to and dried on an aluminum cylinder which had an outer diameter of 30 mm and in which the surface had been roughly machine-finished, and cleaned. A under coat layer, a charge generation layer, and a charge transport layer were thereby formed so that these layers, after drying, had thicknesses of 1.3 μm, 0.4 μm, and 25 μm, respectively. Thus, a photoreceptor drum was produced. Note that, the drying of the charge transport layer was conducted at 130° C. for 60 minutes so as to obtain n electrophotographic photoreceptor drum.

Example 2

The electrophotographic photoreceptor drum was manufactured in the same manner as in Example 1 except that in Example 1, the binder resin used for the charge transport layer was changed to a polycarbonate resin represented by the following formula (PC1) from the polycarbonate resin represented by the above-described formula (PA1).

Formula PC1

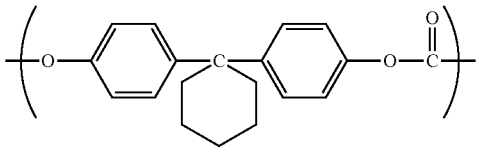

Example 3

The electrophotographic photoreceptor drum was manufactured in the same manner as in Example 1 except that in Example 1, as a solvent of the coating fluid for forming a charge transport layer, a mixed solvent of ortho-xylene/4-methoxy-4-methyl-2-pentanone (80% by mass of ortho-xylene, 20% by mass of 4-methoxy-4-methyl-2-pentanone) was used instead of using the mixed solvent of ortho-xylene/methyl benzoate.

Comparative Example 1

The electrophotographic photoreceptor drum was manufactured in the same manner as in Example 1 except that in Example 1, hydroxygallium phthalocyanine (B) prepared in Synthesis Example 2 was used instead of hydroxygallium phthalocyanine (A) prepared in Synthesis Example 1.

Comparative Example 2

The electrophotographic photoreceptor drum was manufactured in the same manner as in Example 2 except that in Example 2, hydroxygallium phthalocyanine (B) prepared in Synthesis Example 2 was used instead of hydroxygallium phthalocyanine (A) prepared in Synthesis Example 1.

Comparative Example 3

The electrophotographic photoreceptor drum was manufactured in the same manner as in Example 1 except that in Example 1, as a solvent of the coating fluid for a charge transport layer, a mixed solvent of tetrahydrofuran/toluene (80% by mass of tetrahydrofuran, 20% by mass of toluene) was used instead of a mixed solvent of ortho-xylene/methyl benzoate.

Comparative Example 4

The electrophotographic photoreceptor drum was manufactured in the same manner as in Example 1 except that in Example 2, as a solvent of the coating fluid for a charge transport layer, a mixed solvent of tetrahydrofuran/toluene (80% by mass of tetrahydrofuran, 20% by mass of toluene) was used instead of a mixed solvent of ortho-xylene/methyl benzoate.

Comparative Example 5

The electrophotographic photoreceptor drum was manufactured in the same manner as in Example 1 except that in Comparative Example 3, hydroxygallium phthalocyanine (B) prepared in Preparing Example 2 was used instead of hydroxygallium phthalocyanine (A) prepared in Preparing Example 1.

Comparative Example 6

The electrophotographic photoreceptor drum was manufactured in the same manner as in Example 2 except that in Comparative Example 4, hydroxygallium phthalocyanine (B) prepared in Preparing Example 2 was used instead of hydroxygallium phthalocyanine (A) prepared in Preparing Example 1.

Comparative Example 7

The electrophotographic photoreceptor drum was manufactured in the same manner as in Example 1 except that in Example 1, the charge transport layer was dried for 10 minutes at 120° C.

Comparative Example 8

The electrophotographic photoreceptor drum was manufactured in the same manner as in Example 1 except that in Example 1, the charge transport layer was dried for 60 minutes at 150° C.

Measuring of Residual Amount of α-Chloronaphthalene in Charge Generation Layer

The photoconductive drum is dipped into acetone so as to dissolve the acetone-soluble component in the charge transport layer, and an insoluble matter and a swollen binder resin are separated and removed. Subsequently, a portion corresponding to 100 $cm^2$ of the charge generation layer was dipped into 1,2-dimethoxyethane and subjected to ultrasonic treatment so as to prepare a dispersion solution of the charge generation layer, and the dissolved polyvinyl butyral resin was separated by filtration so as to isolate an insoluble hydroxygallium phthalocyanine pigment. The components of the isolated pigment samples were identified and quantified by a GC/MS (SIM) method. For the quantification, first, a calibration curve (peak area vs detection intensity) was created based on a known concentration of α-chloronaphthalene standard, and α-chloronaphthalene was calculated from the calibration curve and the peak area of measurement sample. In addition, a standard material is added before isolating the measurement sample so as to confirm the situation of the recovery rate, and then the detected amount of the solvent is corrected based on the recovery rate.

The residual α-chloronaphthalene was not detected from hydroxygallium phthalocyanine isolated from the charge generation layer of the photoreceptor in Example 1 which has used hydroxygallium phthalocyanine prepared in Synthesis Example 1. On the other hand, 0.5 ng/$cm^2$ of α-chloronaphthalene was detected from hydroxygallium phthalocyanine isolated from the charge generation layer of the photoreceptor in Comparative Example 1 which has used hydroxygallium phthalocyanine prepared in the Synthesis Example 2.

Measuring of Residual Amount of Solvent Having a Boiling Point of 140° C. or More in Charge Transport Layer A certain area of the charge transport layer was separated from the manufactured electrophotographic photoreceptor drum so as to perform the quantification by using a gas chromatograph mass spectrometry (GC-MS) method (Device name: GC portion GC-17A, MS portion GCMS-QP5050 manufactured by Shimadzu Corporation). DB-5MS (manufactured by Agilent Technologies) is used as a column, He is used as carrier gas, and the residual amount of the charge transport layer per unit area (unit: $\mu g/cm^2$) is quantified by setting a standard material of the high boiling point solvent as a reference substance.

Evaluation of Initial Electrical Properties

With an electrophotographic properties evaluation apparatus (described in pages 404 and 405, Basics and Applications of Electrophotographic Technology, compiled by The Society of Electrophotography of Japan, published by Corona Publishing Co., Ltd.) manufactured in accordance with the electrophotographic society measurement standard, the photoconductor sheet was affixed to an aluminum drum to be formed into a cylindrical shape, the aluminum drum and an aluminum substrate of the photoreceptor were electrically connected to each other, and the drum was rotated at constant rotation speed so as to perform the evaluation of electrical properties by a cycle of charging, exposing, measuring potentials, and erasing. Further, the irradiation energy (half decay exposure energy: $\mu j/cm^2$) when the surface potential was half (−350 V) the initial surface potential was measured as the sensitivity ($E_{1/2}$). The smaller the absolute value of VL is, the better the electric properties are, while the smaller the value of $E_{1/2}$ is, the higher the sensitivity is. The measurement was performed under the environment of a temperature of 25° C. and a relative humidity of 50% (N/N). The result is indicated in Table-1.

Repeated Evaluation of Electrical Properties

With an electrophotographic properties evaluation apparatus (described in pages 404 and 405, Basics and Applications of Electrophotographic Technology, compiled by The Society of Electrophotography of Japan, published by Corona Publishing Co., Ltd.) manufactured in accordance with the electrophotographic society measurement standard, the photoreceptor drum was rotated at constant rotation speed of at 60 rpm, the initial surface potential ($V_0$) was set to be −700 V, 780 nm of monochromatic light was used for the exposing, 660 nm of monochromatic light was used for the erasing, and then the light potential (VL) was measured at the time of irradiating the exposure light of 1 $\mu J/cm^2$. At the time of measuring VL, the time required for the exposure to the potential measurement was set to be 139 ms. The cycle of charging, exposing, measuring potentials, and erasing was repeated 10,000 times so as to measure a difference ($\Delta V_0$) of the surface potentials ($V_0$) to be measured, and a difference ($\Delta VL$) of the light potential (VL). The smaller the absolute values of $\Delta V_0$ and $\Delta VL$ are, the better the properties at the time of repeated use are. The measurement was performed under the environment of a temperature of 25° C. and a relative humidity of 50%. The result is indicated in Table-1.

Adhesion Test

The Adhesion, that is, the Adhesion Between the Photosensitive Layer and the undercoat layer, or the substrate, or the cohesive failure in the photosensitive layer was evaluated by a so-called cross cut test. In this case, after inserting a cut (5×5 cross cut) to reach the substrate with respect to the photosensitive layer and the undercoat layer, the cellophane tape was attached and detached off, and the adhesion strength was evaluated according to the degree of residualness. In Table-1, A represents good residual degree, B represents bad residual degree.

Image Test

The image test was performed by using a tandem full-color printer MICROLINEC310dn modified machine (transfer voltage change) manufactured by Oki Data Corporation, which has a dry development type electrophotographic system and a direct transferring method of transferring the image from the photoreceptor to paper through a nonmagnetic single component development, a DC charging roller and a transport belt. At that time, the manufactured photoreceptor drum was mounted on an electrophotographic photoreceptor cartridge for cyan, and A4 paper was printed longitudinally in an environment of 25° C., and 50% RH so as to confirm the occurrence of ghost. At that time, the ghost absence was set as level 5, a case where the ghost in the worst condition was set as level 1, and then five stages of visual evaluation was performed. The result is indicated in Table-1.

TABLE 1

| | Charge generation substance | Charge transport layer binder resin | Charge transport layer coating solvent | Residual amount of solvent having boiling point of 140° C. or more ($\mu g/cm^2$) | ΔV0 (−V) | ΔVL (−V) | Adhesion | Ghost level |
|---|---|---|---|---|---|---|---|---|
| Example 1 | (A) | (PA1) | o-xylene/methyl benzoate | 0.82 | −30 | 9 | A | 5 |
| Example 2 | (A) | (PC1) | o-xylene/methyl benzoate | 1.5 | −44 | −7 | A | 4 |
| Example 3 | (A) | (PA1) | o-xylene/4-methoxy-4-methyl-2-pentanone | 0.2 | −20 | 15 | A | 5 |
| Comparative example 1 | (B) | (PA1) | o-xylene/methyl benzoate | 0.45 | −58 | 10 | B | 3 |
| Comparative example 2 | (B) | (PC1) | o-xylene/methyl benzoate | 1.9 | −66 | −7 | B | 3 |
| Comparative example 3 | (A) | (PA1) | tetrahydrofuran/toluene | — | −29 | 7 | B | 2 |
| Comparative example 4 | (A) | (PC1) | tetrahydrofuran/toluene | — | −20 | −1 | A | 3 |

TABLE 1-continued

| | Charge generation substance | Charge transport layer binder resin | Charge transport layer coating solvent | Residual amount of solvent having boiling point of 140° C. or more ($\mu g/cm^2$) | ΔV0 (−V) | ΔVL (−V) | Adhesion | Ghost level |
|---|---|---|---|---|---|---|---|---|
| Comparative example 5 | (B) | (PA1) | tetrahydrofuran/toluene | — | −53 | 10 | B | 2 |
| Comparative example 6 | (B) | (PC1) | tetrahydrofuran/toluene | — | −44 | −4 | B | 2 |
| Comparative example 7 | (A) | (PA1) | o-xylene/methyl benzoate | 5.2 | −108 | 25 | B | 3 |
| Comparative example 8 | (A) | (PA1) | o-xylene/methyl benzoate | 0.08 | −28 | 185 | A | 1 |

From the result of Table-1, it is understood that when using the specific charge generation layer, and the specific charge transport layer, the stability of electrical properties, the adhesion, and the image ghost become excellent. In addition, when the amount of the non-halogen organic solvent having a boiling point of 140° C. or more is excessively large, the degree of deterioration of the electrical properties and the adhesion becomes larger; in contrast, when the amount of the non-halogen organic solvent having a boiling point of 140° C. or more is excessively small, the degree of deterioration of the electrical properties and the image ghost becomes larger.

This application is based on Japanese patent application JP 2016-024976, filed on Feb. 12, 2016, the entire content of which is hereby incorporated by reference, the same as if set forth at length.

DESCRIPTION OF THE REFERENCE NUMERALS AND SIGNS

1 Photoreceptor (electrophotographic photoreceptor)
2 Charging device (charging roller)
3 Exposure device
4 Developing device
5 Transfer device
6 Cleaner
7 Fixing device
41 Developing vessel
42 Agitator
43 Feed roller
44 Developing roller
45 Control member
71 Upper fixing member (pressurized roller)
72 Lower fixing member (fixing roller)
73 Heater
T Toner
P Recording paper

What is claimed is:

1. A multilayer type electrophotographic photoreceptor comprising:

a conductive support; and on the conductive support, a charge generation layer and a charge transport layer, the charge generation layer comprising a hydroxygallium phthalocyanine pigment, wherein the content of α-chloronaphthalene in the hydroxygallium phthalocyanine pigment in the charge generation layer is in a range of 0 $ng/cm^2$ to 0.1 $ng/cm^2$, the charge transport layer comprises a non-halogen organic solvent having a boiling point of 140° C. or more, the non-halogen organic solvent comprises o-xylene and methyl benzoate, and the content of the non-halogen organic solvent in the charge transport layer is in a range of 0.1 $\mu g/cm^2$ to 5 $\mu g/cm^2$.

2. The multilayer type electrophotographic photoreceptor according to claim 1, wherein the non-halogen organic solvent further comprises at least one selected from the group consisting of ethyl benzoate, benzyl acetate, ethyl 3-ethoxypropionate, diethylene glycol ethyl methyl ether, and 4-methoxy-4-methyl-2-pentanone.

3. The multilayer type electrophotographic photoreceptor according to claim 1, wherein the charge generation layer comprises at least one compound selected from an amino compound, an amide compound, and a urea compound.

4. The multilayer type electrophotographic photoreceptor according to claim 1, wherein the charge transport layer further comprises a polyarylate resin.

5. The multilayer type electrophotographic photoreceptor according to claim 1, wherein the hydroxygallium phthalocyanine is hydroxygallium phthalocyanine crystal which represents an intense diffraction peak at Bragg angles (2θ±0.2) of 28.3° in an X-ray diffraction pattern with CuKα line.

6. An electrophotographic photoreceptor cartridge comprising the electrophotographic photoreceptor according to claim 1.

7. An image forming apparatus comprising:

the electrophotographic photoreceptor according to claim 1;

a charging device;

an exposing device; and a developer.

8. The multilayer type electrophotographic photoreceptor according to claim 1, wherein the hydroxygallium phthalocyanine pigment in the charge generation layer does not contain α-chloronaphthalene.

9. The multilayer type electrophotographic photoreceptor according to claim 3, wherein the content of the at least one compound selected from an amino compound, an amide compound, and a urea compound with respect to the amount of the hydroxygallium phthalocyanine pigment is in a range of 0.05 to 20 mass %.

10. The multilayer type electrophotographic photoreceptor according to claim 3, wherein the content of the at least one compound selected from an amino compound, an amide compound, and a urea compound with respect to the amount of the hydroxygallium phthalocyanine pigment is in a range of 0.2 to 10 mass %.

11. The multilayer type electrophotographic photoreceptor according to claim 1, wherein the content of the non-halogen organic solvent in the charge transport layer is in a range of 0.2 $\mu g/cm^2$ to 2 $\mu g/cm$2.

* * * * *